US009085815B2

(12) United States Patent
Kim et al.

(10) Patent No.: US 9,085,815 B2
(45) Date of Patent: Jul. 21, 2015

(54) MAGNESIUM ALLOY FOR ROOM TEMPERATURE AND MANUFACTURING METHOD THEREOF

(75) Inventors: Shae K. Kim, Seoul (KR); Jung-Ho Seo, Seoul (KR)

(73) Assignee: KOREA INSTITUTE OF INDUSTRIAL TECHNOLOGY, Cheonan (KR)

( * ) Notice: Subject to any disclaimer, the term of this patent is extended or adjusted under 35 U.S.C. 154(b) by 291 days.

(21) Appl. No.: 13/053,816

(22) Filed: Mar. 22, 2011

(65) Prior Publication Data

US 2011/0236250 A1 Sep. 29, 2011

(30) Foreign Application Priority Data

Mar. 29, 2010 (KR) ..... 10-2010-0028151
Jan. 6, 2011 (KR) ..... 10-2011-0001557

(51) Int. Cl.
*C22C 23/00* (2006.01)
*C22C 1/02* (2006.01)
*C22C 23/02* (2006.01)

(52) U.S. Cl.
CPC . *C22C 23/00* (2013.01); *C22C 1/02* (2013.01); *C22C 23/02* (2013.01)

(58) Field of Classification Search
CPC ..... C22C 1/02; C22C 23/00; C22C 23/02
USPC ..... 420/402, 407; 75/604
See application file for complete search history.

(56) References Cited

U.S. PATENT DOCUMENTS 4,705,561 A 11/1987 Green
6,139,651 A * 10/2000 Bronfin et al. ..... 148/420
2011/0236251 A1* 9/2011 Kim et al. ..... 420/409

FOREIGN PATENT DOCUMENTS

JP 4467641 B2 3/2010
KR 1020060094734 A 8/2006
KR 1020090071903 A 7/2009
WO WO 2010/032893 A1 3/2010

OTHER PUBLICATIONS

Jang et al, Effect of CaO on AZ31 Mg strip castings, Material Transactions, vol. 49, No. 5, Apr. 2008, pp. 976-979.*
Jin-Kyu Lee et al., "Development of Eco-Mg Alloy", Journal of the Korean Foundrymen's Society, Jun. 2009, vol. 29 No. 3.

* cited by examiner

*Primary Examiner* — Jie Yang

(57) ABSTRACT

Provided is a magnesium alloy for room temperature, which is manufactured by adding CaO onto a surface of a molten magnesium alloy and exhausting the CaO through a reduction reaction of the CaO with the molten magnesium alloy. Resultantly, the magnesium alloy with CaO added has more improved room-temperature mechanical properties (tensile strength, yield strength, elongation) than magnesium alloys without using CaO. Furthermore, as the added amount of CaO increases, room-temperature mechanical properties (tensile strength, yield strength, elongation) increase as well.

14 Claims, 23 Drawing Sheets

MAGNESIUM ALLOY FOR ROOM TEMPERATURE AND MANUFACTURING METHOD THEREOF

BACKGROUND OF THE INVENTION

1. Field of the Invention

The present invention relates to a high-strength/high-elongation magnesium alloy for room temperature, and a manufacturing method thereof.

2. Description of the Prior Art

Currently, Mg—Al based alloys are widely used in industries. When aluminum (Al) is added into a magnesium (Mg) alloy, the strength of the Mg alloy is increased, the melting point is lowered, and flowability is improved because of solid-solution strengthening due to Al and grain boundary strengthening due to the formation of $\beta$-$Mg_{17}Al_{12}$ phase. Therefore, Mg alloys with Al added are suitable for die casting applications. However, ductility is deteriorated due to the increase in $\beta$ phases which are highly brittle. To apply magnesium alloys to automobile parts, magnesium alloys should not be broken at once but endure an impact by absorbing impact energy even if the impact is exerted thereon. For this reason, magnesium alloys should have high ductility at room temperature. Improvement of ductility makes it possible to secure processability and product moldability as well.

Therefore, to secure the strength and castability of magnesium alloys, it is necessary to develop Mg—Al based alloys having high ductility in which an addition ratio of Al should be maintained to a predetermined level or more. In general, increasing ductility is in trade-off relation to strength. If an increase in ductility leads to a decrease in strength, this also provides a limitation to application fields of alloys and it is thus difficult to commercialize Mg alloys.

Accordingly, the ductility and strength should be considered at the same time. To improve the ductility of Mg—Al alloys, the formation of highly brittle $\beta$ phases should be suppressed by forming a new phase through addition of elements which are highly reactive with Mg or Al.

SUMMARY OF THE INVENTION

An object of the present invention is to provide a magnesium alloy for room temperature obtained by adding an alkaline earth metal oxide (especially, calcium oxide) into molten magnesium or magnesium alloy, and a manufacturing method thereof.

Another object of the present invention is to provide a magnesium alloy for room temperature which is capable of improving ductility and strength at the same time by enhancing internal soundness of a casting, for example, reducing oxides, inclusions and pores, through the addition of CaO into a magnesium alloy, and a manufacturing method of the magnesium alloy for room temperature.

Objects of the present invention are not limited to the aforesaid, and other objects not described herein will be clearly understood by those skilled in the art from descriptions below.

In accordance with an exemplary embodiment of the present invention, a method of manufacturing a magnesium-based alloy includes: melting magnesium or magnesium alloy; adding 0.05% to 1.2% by weight of calcium oxide (CaO) onto a surface of a melt in which the magnesium or magnesium alloy is melted; exhausting the CaO through surface stirring to allow the CaO not to substantially remain in the magnesium or magnesium alloy through a sufficient reaction between the melt and the CaO; and allowing calcium (Ca) produced by the reaction to react with the melt such that the Ca does not substantially remain in the magnesium or magnesium alloy.

Specifically, an added amount of the CaO may be in the range of 0.2 wt % to 0.9 wt %. An added amount of the CaO may be in the range of 0.3 wt % to 0.7 wt %.

A compound produced due to the addition of Ca may include at least one of $Mg_2Ca$, $Al_2Ca$ and $(Mg, Al)_2Ca$.

In accordance with another exemplary embodiment of the present invention, a magnesium-based alloy is characterized by that the magnesium-based alloy is manufactured by adding 0.05% to 1.2% by weight of CaO into a molten magnesium or magnesium alloy, and partially or wholly exhausting the CaO through a reduction reaction of the CaO with the molten magnesium or magnesium alloy, wherein the magnesium-based alloy contains a compound formed through combination of Ca with Mg or other alloying elements in the magnesium-based alloy to thereby have larger room-temperature mechanical properties than those of magnesium or magnesium alloys into which CaO is not added.

Specifically, the room-temperature mechanical properties are any one of room-temperature yield strength, room-temperature tensile strength, and room-temperature elongation.

The room-temperature mechanical properties may increase as the added amount of CaO increases. The room-temperature yield strength or room-temperature tensile strength may increase at the same time with the room-temperature elongation as the added amount of CaO increases.

The added amount of the CaO may be in the range of 0.2 wt % to 0.9 wt %, and the added amount of the CaO may be in the range of 0.3 wt % to 0.7 wt %. The compound produced due to the addition of Ca may include at least one of $Mg_2Ca$, $Al_2Ca$ and $(Mg, Al)_2Ca$.

As described above, according to the present invention, when CaO is added into a commercially available magnesium alloy, the microstructure of the magnesium alloy becomes finer in which $Al_2Ca$ phases or the like are formed. Furthermore, the addition of CaO prevents the formation of $\beta$-$Mg_{17}Al_{12}$ phases which are highly brittle, and significantly reduces casting defects.

Consequently, the addition of CaO results in an increase in both of strength and ductility of a magnesium alloy at the same time.

BRIEF DESCRIPTION OF THE DRAWINGS

Exemplary embodiments can be understood in more detail from the following description taken in conjunction with the accompanying drawings, in which.

DETAILED DESCRIPTION OF THE INVENTION

Figure 1:
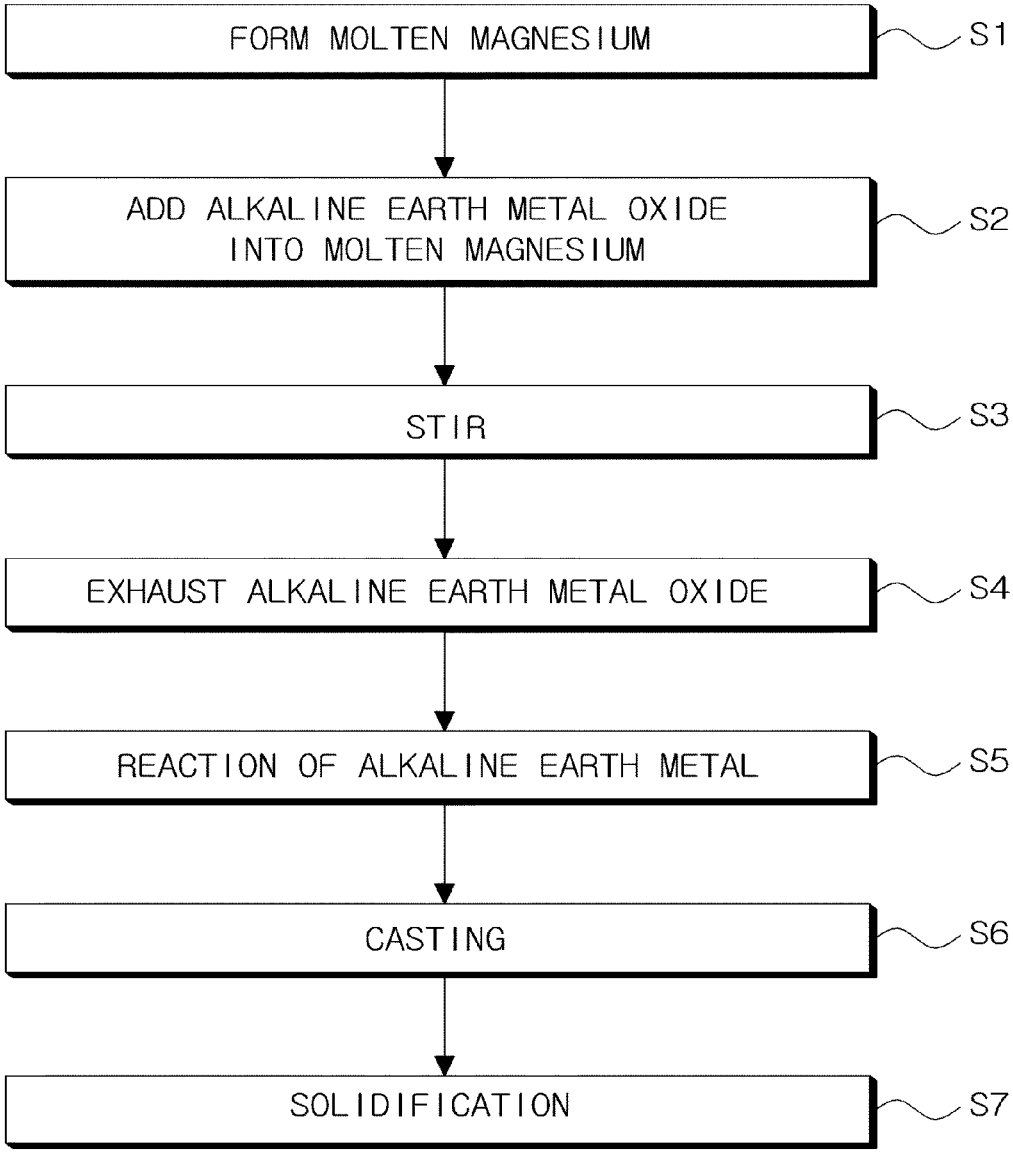
FIG. 1 is a flowchart illustrating a method of manufacturing a magnesium-based alloy according to the present invention.

Preferred embodiments of the present invention will be described below in more detail with reference to the accompanying drawings. In every possible case, like reference numerals are used for referring to the same or similar elements in the description and drawings. Moreover, detailed descriptions related to well-known functions or configurations will be ruled out in order not to unnecessarily obscure subject matters of the present invention.

In the present invention, a manufacturing method of a new alloy by adding CaO into molten magnesium and an alloy thereof are used to solve problems arising when calcium is added to magnesium and overcome limitations of physical properties.

FIG. 1 is a flowchart illustrating a method of manufacturing a magnesium-based alloy according to the present invention.

As illustrated in FIG. 1, a method of manufacturing a magnesium-based alloy according to the present invention includes the steps of: forming a magnesium-based melt (S1); adding alkaline earth metal oxide (CaO in the present invention) (S2); stirring the magnesium-based melt (S3); exhausting the alkaline earth metal oxide (S4); allowing alkaline earth metal (Ca in the present invention) to react with the magnesium-based melt (S5); casting (S6); and solidifying (S7). Although step S4 of exhausting the alkaline earth metal oxide and step S5 of allowing the alkaline earth metal to react with the magnesium-based melt are divided into the separate steps for convenience of description, two steps S4 and S5 occur almost at the same time. That is, when supplying of the alkaline earth metal starts in step 4, step S5 is initiated.

In step S1 of forming the magnesium-based melt, magnesium or magnesium alloy is put into a crucible and heated at a temperature ranging from 400° C. to 800° C. under a protective gas atmosphere. Then, the magnesium alloy in the crucible is melted to form the magnesium-based melt.

—Melting Temperature of Magnesium or Magnesium Alloy

The temperature provided herein for melting magnesium or magnesium alloys means a melting temperature of pure magnesium or magnesium alloys. The melting temperature may vary with alloy type. For a sufficient reaction, CaO is added in the state where magnesium or the magnesium alloy is completely melted. A temperature at which a solid phase is sufficiently melted to exist in a complete liquid phase is enough for the melting temperature of magnesium or the magnesium alloy. However, in the present invention, work is necessary to maintain a molten magnesium in the temperature range with sufficient margin by considering the fact that the temperature of the molten magnesium is decreased due to the addition of CaO.

Herein, when the temperature is less than 400° C., the molten magnesium alloy is difficult to be formed. On the contrary, when the temperature is more than 800° C., there is a risk that the magnesium-based melt may be ignited. A molten magnesium is generally formed at a temperature of 600° C. or more, whereas a molten magnesium alloy may be formed at a temperature ranging from 400° C. or more to 600° C. or less. In general, many cases in metallurgy show that a melting point decreases as alloying proceeds.

When the melting temperature is increased too high, vaporization of liquid metal may occur. Also, magnesium easily ignites due to its own characteristic so that the molten magnesium may be lost and an adverse effect may be exerted on final physical properties.

The magnesium used in step S1 of forming the magnesium-based melt may be any one selected from pure magnesium, a magnesium alloy, and equivalents thereof. Also, the magnesium alloy may be any one selected from AZ91D, AM20, AM30, AM50, AM60, AZ31, AS41, AS31, AS21X, AE42, AE44, AX51, AX52, AJ50X, AJ52X, AJ62X, MRI153, MRI230, AM-HP2, magnesium-Al, magnesium-Al—Re, magnesium-Al—Sn, magnesium-Zn—Sn, magnesium-Si, magnesium-Zn—Y, and equivalents thereof; however, the present invention is not limited thereto. Any magnesium alloy that is generally available in industries may be used.

In step S2 of adding the alkaline earth metal oxide, CaO in the form of powder is added into the molten magnesium. It is preferable that CaO be powdered for accelerating the reaction with the magnesium alloy.

—Powder Form of CaO

Any form of CaO may be input for the reaction. Desirably, CaO may be added in a powder state so as to increase a surface area for efficient reaction. If the additive is too fine, that is, less than 0.1 μm in size, the additive is liable to be scattered by vaporized magnesium or hot wind, thereby making it difficult to input the additive into a furnace. Further, the additives are agglomerated each other, and thus clustered while not being easily mixed with liquid molten metal. On the contrary, if the powder is too coarse, it is undesirable because a total surface area is not increased. It is preferable that an ideal particle size should not exceed 500 μm. More preferably, the particle size may be 200 μm or less.

In order to prevent powder phases from being scattered, it is possible to input CaO in the form of pellet that is agglomerated from the powder form.

—Added Alkaline Earth Metal Oxide (Calcium Oxide)

In the present invention, CaO was used as an alkaline earth metal oxide added into the molten magnesium. In addition, any one selected from strontium oxide (SrO), beryllium oxide (BeO), magnesium oxide (MgO), and equivalents thereof may be used as the alkaline earth metal oxide.

The alkaline earth metal oxide, which is used in step S2 of adding the alkaline earth metal oxide, may be generally added in the range of 0.001 wt % to 30 wt %.

An input amount of the alkaline earth metal oxide is determined by a final target alloy composition. That is, an amount of CaO may be determined by performing a back-calculation according to a desired amount of Ca to be alloyed into a magnesium alloy. Physical properties of the magnesium alloy deviate from its original physical properties if the amount of Ca, which is indirectly alloyed into the magnesium alloy from the CaO, exceeds 21.4 wt % (30 wt % in the case of CaO), and therefore, it is preferable that the input amount of CaO should be adjusted to 30 wt % or less.

In the present invention, the input amount of CaO used as the alkaline earth metal oxide is in the range of 0.05 wt % to 1.2 wt %. Excellent physical properties such as room-temperature high strengths (tensile strength/yield strength) and room-temperature elongation could be obtained when the input amount of CaO was 1.2 wt % or less. Improvement of the physical properties was not relatively large when the input amount was less than 0.05 wt %. More preferably, the input amount of CaO is in the range of 0.2 wt % to 0.9 wt %. Much more preferably, the input amount of CaO is in the range of 0.3 wt % to 0.7 wt %. Excellent physical properties, i.e., excellent room-temperature high strength/high elongation could be obtained in the case where the input amount of CaO is in the range of 0.3 wt % to 0.7 wt %. Also, in the range of 0.3 wt % to 0.7 wt % of CaO, room-temperature mechanical properties (tensile strength, yield strength, elongation) were increased as the amount of CaO was increased.

In the stirring step S3, the molten magnesium is stirred for 1 second to 60 minutes per 0.1 wt % of the added CaO.

Here, if the stirring time is less than 1 second/0.1 wt %, CaO is not mixed with the molten magnesium sufficiently; and, if the stirring time is more than 60 minutes/0.1 wt %, the stirring time of the molten magnesium may be unnecessarily lengthened. In general, the stirring time depends on the volume of the molten magnesium and the input amount of CaO.

The oxide powders of a required amount may be input at once. However, to accelerate the reaction and reduce agglomeration possibility, it is preferable that the additive powders be re-input after a predetermined time elapses from a first input time, or the additive powders are grouped into several batches of appropriate amounts and the batches are input in sequence.

—Stirring Method and Conditions

It is preferable to stir the molten magnesium for the efficient reaction between the magnesium or magnesium alloy and the calcium oxide in the present invention. The stirring may be generally performed by generating an electromagnetic field using a device capable of applying electromagnetic fields around the furnace holding the molten magnesium, thus enabling the convection of the molten magnesium to be induced. Also, artificial stirring (mechanical stirring) may be performed on the molten magnesium from the outside. In the case of mechanical stirring, the stirring may be performed in such a manner that the CaO powders are not agglomerated. The ultimate purpose of the stirring in the present invention is to induce the reduction reaction between the molten magnesium and added powders properly.

The stirring time may vary with the temperature of a molten metal and the state (pre-heating state or the like) of powders added. Preferably, the stirring may continue to be performed in principle until the powders are not observed on the surface of the molten magnesium. Since the powders are lower in specific gravity than the molten magnesium so that they float on the molten magnesium in a normal state, it can be indirectly determined that the powders and the molten magnesium sufficiently react when the powders are not observed on the molten magnesium any longer. Herein, the term 'sufficiently react' means that all of the CaO powders substantially react with the molten magnesium and are exhausted.

Although the CaO powders are not observed on the molten magnesium, possibilities of existing in the molten magnesium may not be excluded. Therefore, the CaO powders that do not float yet should be observed for a predetermined holding time after the stirring time, and the holding time may be required to complete the reaction of the CaO powders that have not reacted with the molten magnesium yet.

—Stirring Time

The stirring is effective when it is performed at the same time with the input of the oxide powders. In addition, the stirring may start after the oxide receives heat from the molten magnesium and reach a predetermined temperature or higher, which enables acceleration of the reaction. The stirring continues to be performed until the oxide powders are not observed on the surface of the molten magnesium. After CaO is completely exhausted through the reaction, the stirring is finished.

—Surface Reaction

In general, when Ca and Sr of the alkaline earth metals are directly added into the molten magnesium, reactions occur as Ca and Sr sink into the molten magnesium having low specific gravity. Therefore, alloying may be completed by simply stirring the molten magnesium to help dissolution of Ca.

On the contrary, when CaO is input into the molten magnesium, CaO does not sink into the molten magnesium but floats on the surface of the molten magnesium due to a difference in specific gravity.

In the case of typical metal alloying, it is in general that reactions are forced to occur in a molten metal by inducing an active reaction by convection or stirring of the molten magnesium and alloying metal elements.

However, in the present invention, when the reaction was induced actively, the oxide inputted into the molten magnesium could not react and remained in the final material so that physical properties were deteriorated or it acted as the cause of defects. That is, when the reaction was induced inside the molten magnesium, not on the surface of the molten magnesium, there were relatively more cases where the calcium oxide remained in the final molten magnesium rather than reacted on the surface of the molten magnesium.

In the present invention, therefore, it is important to create a reaction environment where an oxide reacts on the surface rather than inside the molten magnesium. To this end, it is important not to forcibly stir the oxide floating on the surface of the molten magnesium into the molten magnesium. It is important to uniformly spread the oxide floating on the molten magnesium surface exposed to air. More preferably, it is important to supply the oxide in such a way as to coat the entire surface of the molten magnesium with the oxide.

Reaction occurred better in the case of stirring the molten magnesium, and also reaction occurred better at an outer surface (surface of an upper layer portion) rather than inside the molten magnesium. That is, the molten magnesium reacted better with the oxide powders exposed to air at the outer surface (surface of an upper layer portion) thereof. However, results were not satisfactory under a state of vacuum or ambient gas. For sufficient reaction, it is necessary to induce the surface reaction through stirring of the upper layer portion. Herein, the term 'sufficiently react' means that all of the alkaline earth metal oxides react with the molten magnesium and do not remain in the molten magnesium substantially. In the present invention, the stirring inducing the foregoing surface reaction is denoted as surface stirring. That is, Ca, which is produced by a reduction reaction (surface reduction reaction) of the CaO added onto the surface of the molten Mg, acts as an alloying element of Mg or Mg alloys.

In Table 1 below, after adding 5 wt %, 10 wt % and 15 wt % of calcium oxide having a particle size of 70 μm into a molten AM60B magnesium alloy, respectively, residual amounts of the calcium oxide in the magnesium alloy according to stirring methods were measured. The stirring methods used herein were the stirring of the upper layer portion of molten magnesium alloy, the stirring of the inside of the molten magnesium alloy, and the rest method was no stirring. According to various stirring conditions, when comparing the case of the stirring of only the upper layer portion with the cases of no stirring and the stirring of the inside of the molten magnesium alloy, the smallest residual amount of the calcium oxide was observed in the case of the stirring of only the upper layer portion, that is, the final residual amounts of the calcium oxide were 0.001 wt %, 0.002 wt % and 0.005 wt % as the calcium oxide was added 5 wt %, 10 wt % and 15 wt %, respectively. That is, it can be understood that, when the upper layer portion of the molten magnesium alloy is stirred to allow CaO to react at the outer surface of the molten magnesium, most of CaO is decomposed into Ca. That is, Ca was added into the magnesium alloy by inducing the reduction reaction through further addition of CaO into the commercially available AM60B alloy.

TABLE 1

| | | Addition of 5 wt % of CaO | Addition of 10 wt % of CaO | Addition of 15 wt % of CaO |
|---|---|---|---|---|
| Residual amount of CaO in the alloy | No stirring | 4.5 wt % CaO | 8.7 wt % CaO | 13.5 wt % CaO |
| | Stirring the inside of the molten magnesium alloy | 1.2 wt % CaO | 3.1 wt % CaO | 5.8 wt % CaO |

TABLE 1-continued

| | | Addition of 5 wt % of CaO | Addition of 10 wt % of CaO | Addition of 15 wt % of CaO |
|---|---|---|---|---|
| | Stirring the upper layer portion of the molten magnesium alloy (present invention) | 0.001 wt % CaO | 0.002 wt % CaO | 0.005 wt % CaO |

The oxygen component of CaO is substantially removed out from the top surface of the molten magnesium by stirring the upper layer portion of the molten magnesium. It is desirable that the stirring is performed at an upper layer portion of which a depth is about 20% of a total depth of the molten magnesium from the surface. If the depth is beyond 20%, the surface reaction according to a preferred example of the present invention is rarely generated. More preferably, the stirring may be performed in an upper layer portion of which a depth is about 10% of the total depth of the molten magnesium from the surface. The substantially floating CaO is induced to be positioned in an upper layer portion of which a depth is 10% of an actual depth of the molten magnesium, thereby minimizing the turbulence of the molten magnesium.

In step S4 of exhausting the alkaline earth metal oxide, through the reaction between the molten magnesium and the added calcium oxide, the calcium oxide is completely exhausted so as not to remain in the magnesium alloy at least partially or substantially. It is preferable that all the calcium oxide added in the present invention is exhausted by a sufficient reaction. However, even if some portions do not react and remain in the alloy, it is also effective if these do not largely affect physical properties.

Herein, the exhausting of calcium oxide includes removing an oxygen component from the alkaline earth metal oxide. The oxygen component is removed in the form of oxygen gas ($O_2$) or in the form of dross or sludge through combination with magnesium or alloying components in the molten magnesium. Herein, Ca provided from the CaO is prone to be compounded with elements other than Mg in the magnesium alloy. The oxygen component is substantially removed out from the top surface of the molten magnesium by stirring the upper layer portion of the molten magnesium.

Figure 3:
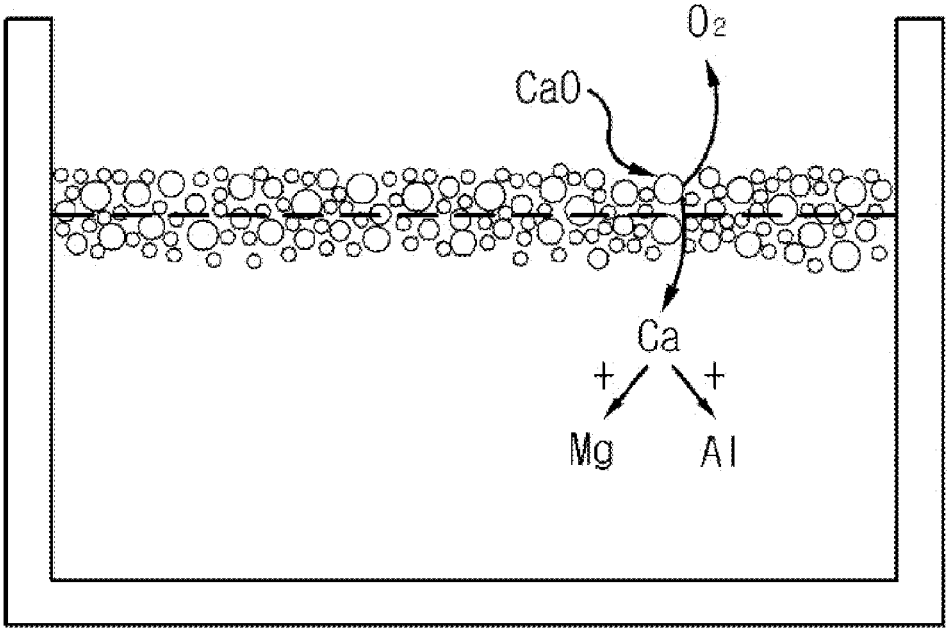
FIG. 3 is a schematic view illustrating dissociation of an alkaline earth metal oxide (CaO) through stirring of an upper layer portion of a magnesium alloy according to the present invention.

FIG. 3 is a schematic view exemplarily showing dissociation of calcium oxide through stirring of an upper layer portion of molten magnesium according to the present invention.

In step S5 of allowing the alkaline earth metal to react with the molten magnesium, calcium produced by the exhaustion of the calcium oxide reacts with the molten magnesium alloy so as not to at least partially or substantially remain in the magnesium alloy. This means that Ca produced by the dissociation is compounded with at least one of magnesium, aluminum, and other alloying elements (components) in the magnesium alloy, and is thus not left remaining substantially. Here, a compound collectively refers to an intermetallic compound obtained through bonding between metals.

In the end, the added calcium oxide is partially or substantially exhausted by removing the oxygen component through the reaction with the magnesium alloy, i.e., the molten magnesium alloy, and the produced calcium makes a compound with at least one of magnesium, aluminum, and other alloying elements in the molten magnesium alloy. Thus, calcium oxide does not remain in the alloy partially or substantially.

In step 5 of exhausting the alkaline earth metal oxide, there occur many flint flashes during the reduction reaction of the alkaline earth metal oxide on the surface of the molten magnesium. The flint flashes may be used as an index for confirming whether the reduction reaction is completed or not. In the case of terminating the reaction by tapping the molten magnesium while the flint flashes are being generated, the alkaline earth metal oxide added may not be fully exhausted. That is, the tapping of the molten magnesium is performed after the flint flashes, which can be used as an index for indirectly measuring the reduction reaction, disappear.

Figure 2:
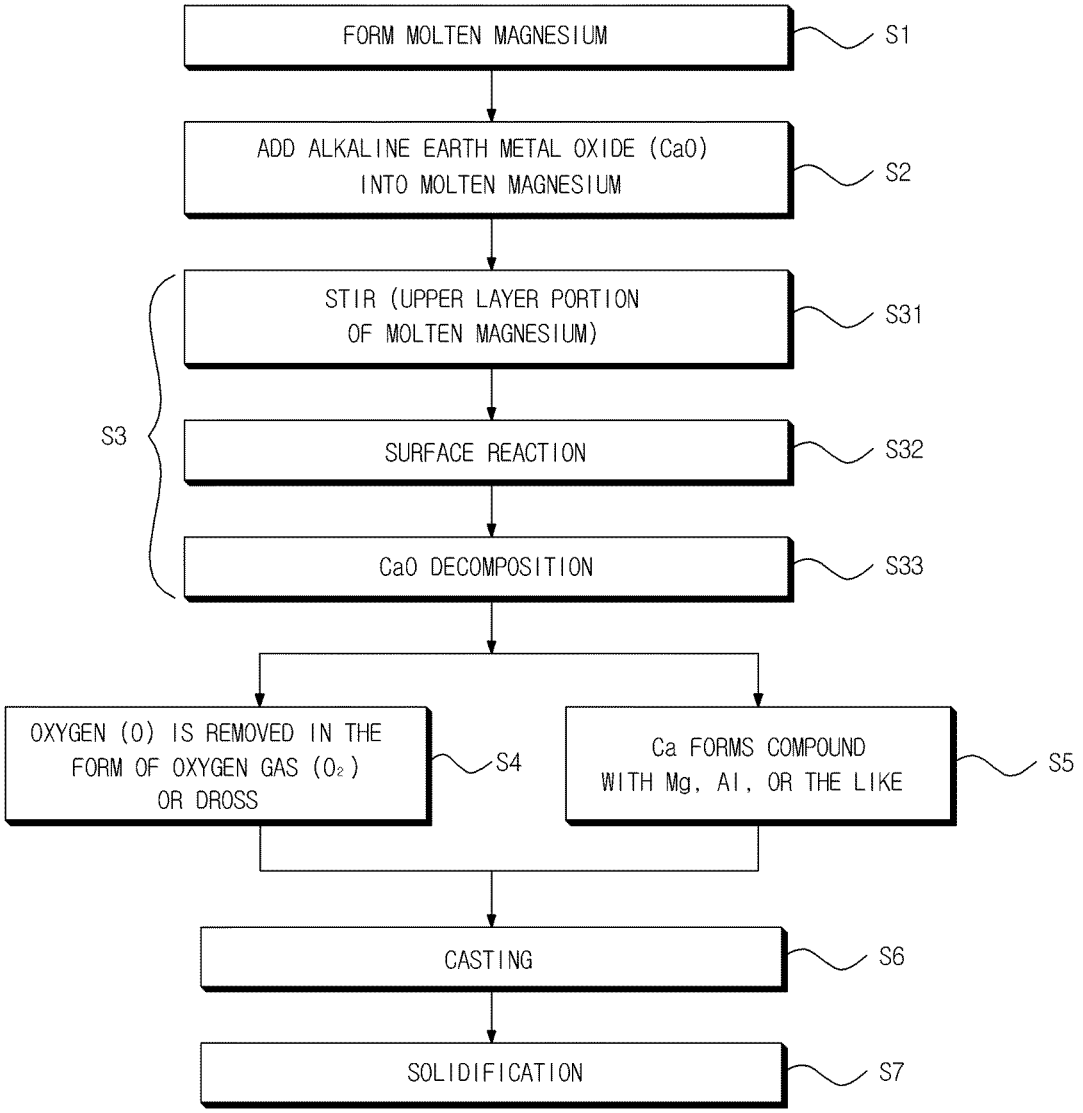
FIG. 2 is a flowchart illustrating dissociation of an alkaline earth metal oxide (CaO) added into a magnesium alloy according to the present invention.

Processes described until now are illustrated in FIGS. 1 and 2. FIG. 2 is a flowchart illustrating dissociation of calcium oxide used to be added into a molten magnesium according to the present invention.

In the casting step S6, casting is performed by putting the molten magnesium into a mold at room temperature or in a pre-heating state. Herein, the mold may include any one selected from a metallic mold, a ceramic mold, a graphite mold, and equivalents thereof. Also, the casting method may include gravity casting, continuous casting, and equivalent methods thereof.

In the solidifying step S7, the mold is cooled down to room temperature, and thereafter, the magnesium alloy (e.g., magnesium alloy ingot) is taken out from the mold.

The magnesium-based alloy formed by the above-described manufacturing method may have hardness (HRF) of 40 to 80. However, the hardness value may change widely depending on processing methods and heat treatment or the like, and thus the magnesium-based alloy according to the present invention is not limited thereto.

In pure molten magnesium, magnesium in the molten magnesium reacts with alkaline earth metal to thereby form a magnesium (alkaline earth metal) compound. For example, if the alkaline earth metal oxide is CaO, $Mg_2Ca$ is formed. Oxygen constituting CaO is discharged out of the molten magnesium in the form of oxygen gas ($O_2$), or combines with Mg to be MgO and is then discharged in the form of dross (see Reaction Formula 1 below). (see Reaction Formula 1 below).

Pure Mg+CaO−>Mg(Matrix)+$Mg_2Ca$ . . . [$O_2$ produced+MgO dross produced] Reaction Formula 1

In a molten magnesium alloy, magnesium in the molten magnesium alloy reacts with alkaline earth metal to thereby form a magnesium (alkaline earth metal) compound or an aluminum (alkaline earth metal) compound. Also, an alloying element reacts with alkaline earth metal to form a compound together with magnesium or aluminum. In the present invention, when the alkaline earth metal oxide is CaO, $Mg_2Ca$, $Al_2Ca$, or (Mg, Al, other alloying element)$_2$Ca is formed. Oxygen constituting CaO is discharged out of the molten magnesium in the form of oxygen gas ($O_2$) as in the pure Mg case, or combines with Mg to be MgO, which is discharged in the form of dross (see Reaction Formula 2 below).

Mg Alloy+CaO−>Mg Alloy(Matrix)+{$Mg_2Ca$+$Al_2Ca$+(Mg,Al,other alloying element)2Ca} . . . [$O_2$ produced+MgO dross produced] Reaction Formula 2

As described above, the present invention makes it possible to manufacture a magnesium alloy economically when compared to conventional methods of manufacturing a magnesium alloy. An alkaline earth metal (e.g., Ca) is relatively a high-priced alloying element as compared to an alkaline earth metal oxide (e.g., CaO), and thus it acts as a main factor of increasing the price of magnesium alloys. Also, alloying is relatively easy by adding alkaline earth metal oxide into magnesium or magnesium alloy instead of adding alkaline earth metal. On the other hand, alloying effects equal to or greater than the case of directly adding alkaline earth metal (e.g., Ca) can be achieved by adding the chemically stable alkaline earth metal oxide (e.g., CaO). That is, Ca, which is produced by the reduction reaction of the CaO added into the molten Mg, acts as an alloying element of Mg or Mg alloys.

Also, dissolution of the alkaline earth metal in the magnesium alloy occurs in a certain amount when the alkaline earth metal is directly input into magnesium or the magnesium alloy. In contrast, in the case of applying technology of the present invention, dissolution is absent or extremely small during the addition of the alkaline earth metal oxide (CaO) when comparing degree of the dissolution with the case of directly adding the alkaline earth metal. It was confirmed that an intermetallic compound including an $Al_2Ca$ phase forms much easier when Ca is indirectly added through CaO as compared to the case of directly adding Ca. Therefore, in order to improve physical properties of the magnesium alloy, addition of more than a certain fraction of the alkaline earth metal is required. On the other hand, in the case of manufacturing the magnesium alloy by adding the alkaline earth metal oxide, it can be observed that the physical properties are more improved than the case of directly adding Ca due to the fact that a considerable amount of alkaline earth metal produced from the alkaline earth metal oxide forms intermetallic compounds with Mg or Al (e.g., $Mg_2Ca$ or $Al_2Ca$). It was confirmed that 95% or more of the intermetallic compounds including $Al_2Ca$ are formed at grain boundaries and the rest of less than 5% are formed in the grains.

Figure 4A:
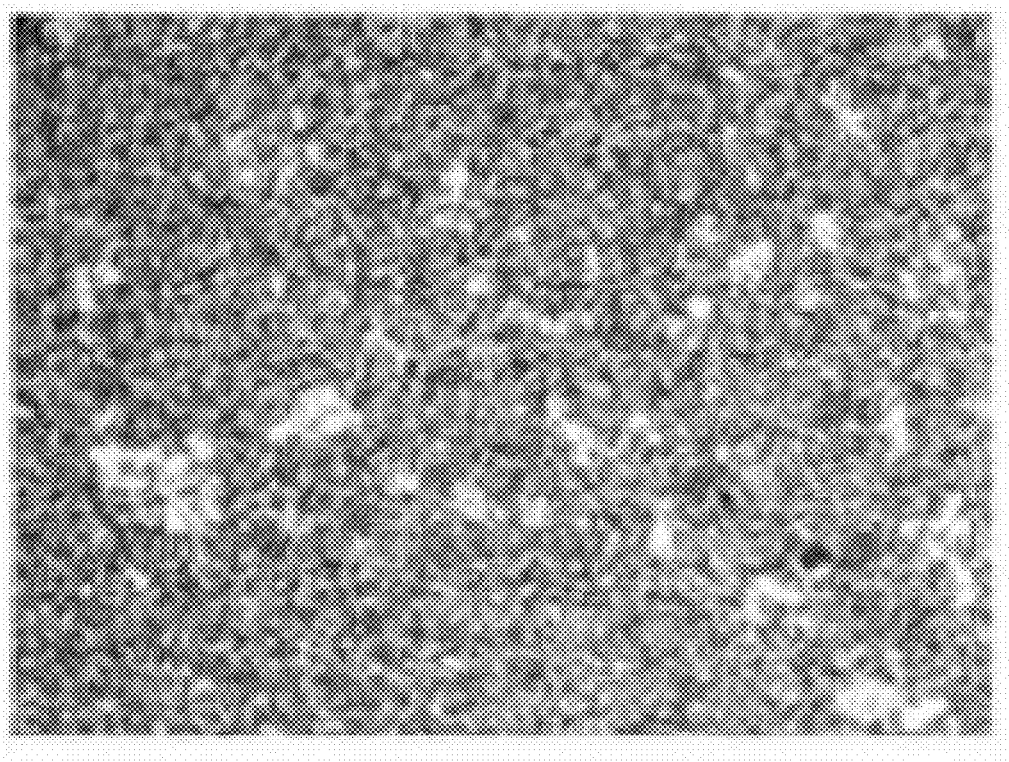
FIG. 4*a* is an image showing a microstructure of a die-cast product using AZ91D according to a comparative example.
Figure 4B:
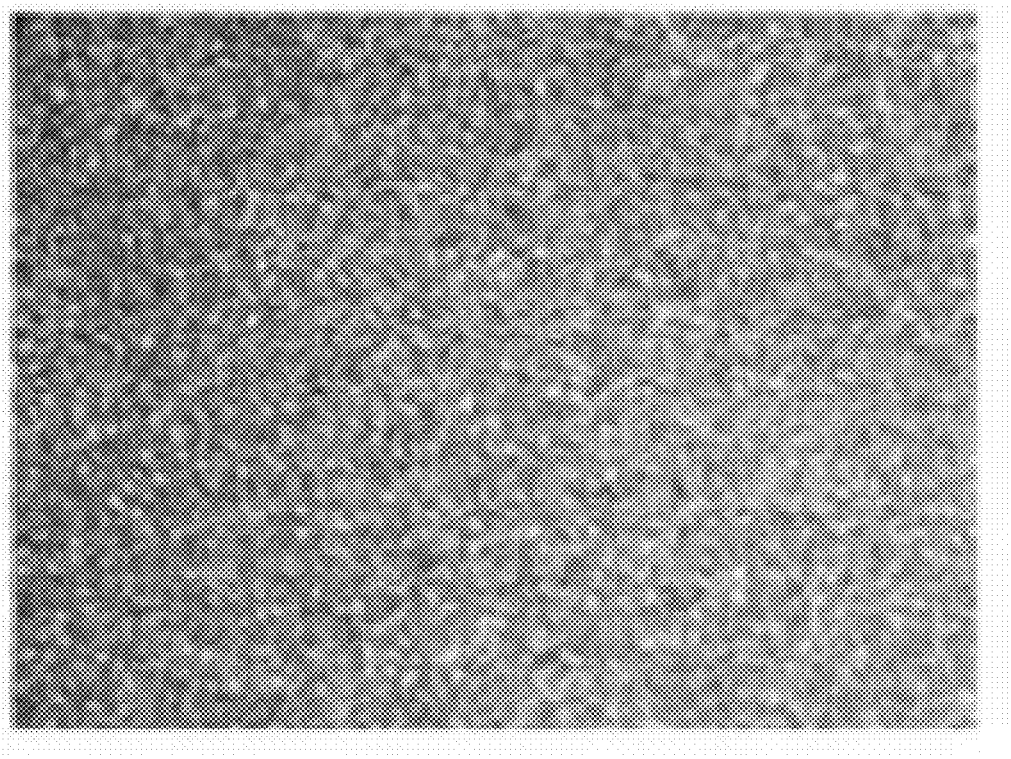
FIGS. 4*b* and 4*c* are images showing microstructures of die-cast products of Mg alloys prepared by adding 0.3% and 0.7% by weight of CaO into AZ91D, respectively, according to the present invention.
Figure 4C:
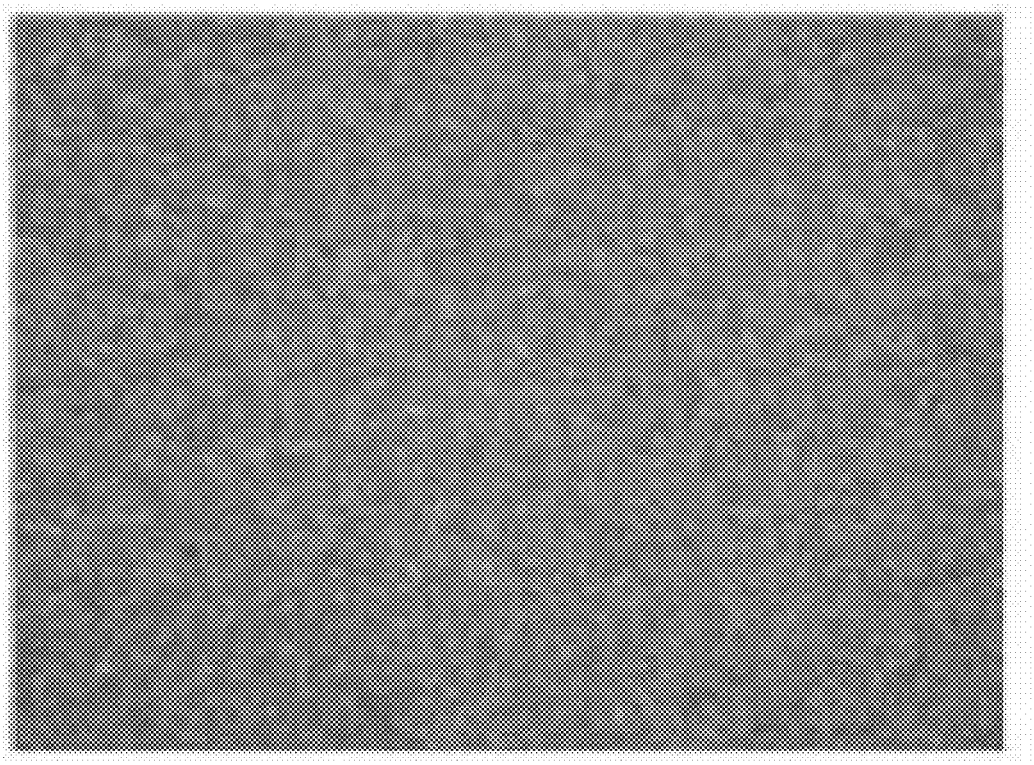
Figure 5A:
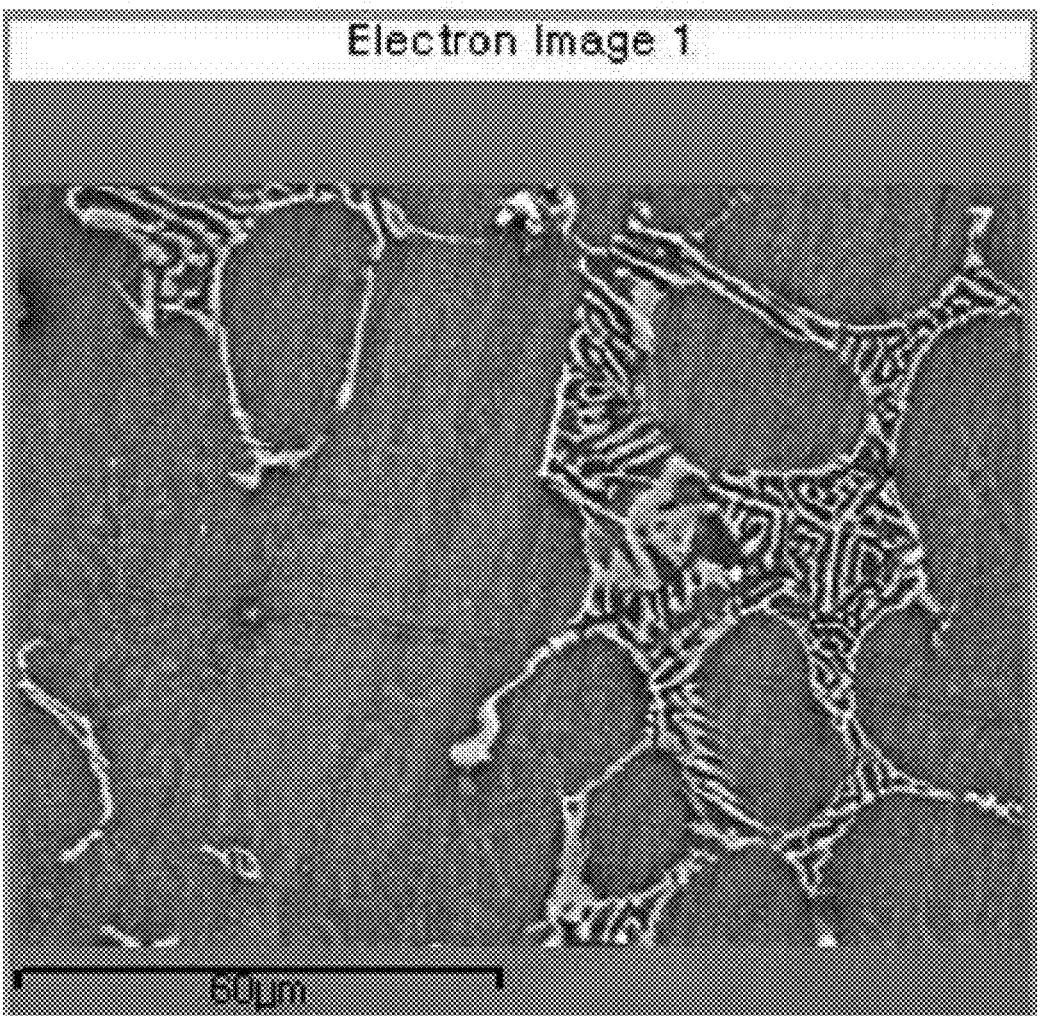
FIGS. 5*a* to 5*d* are images showing EDS experimental results of magnesium alloys prepared by a manufacturing method of a magnesium-based alloy according to the present invention.
Figure 5B:
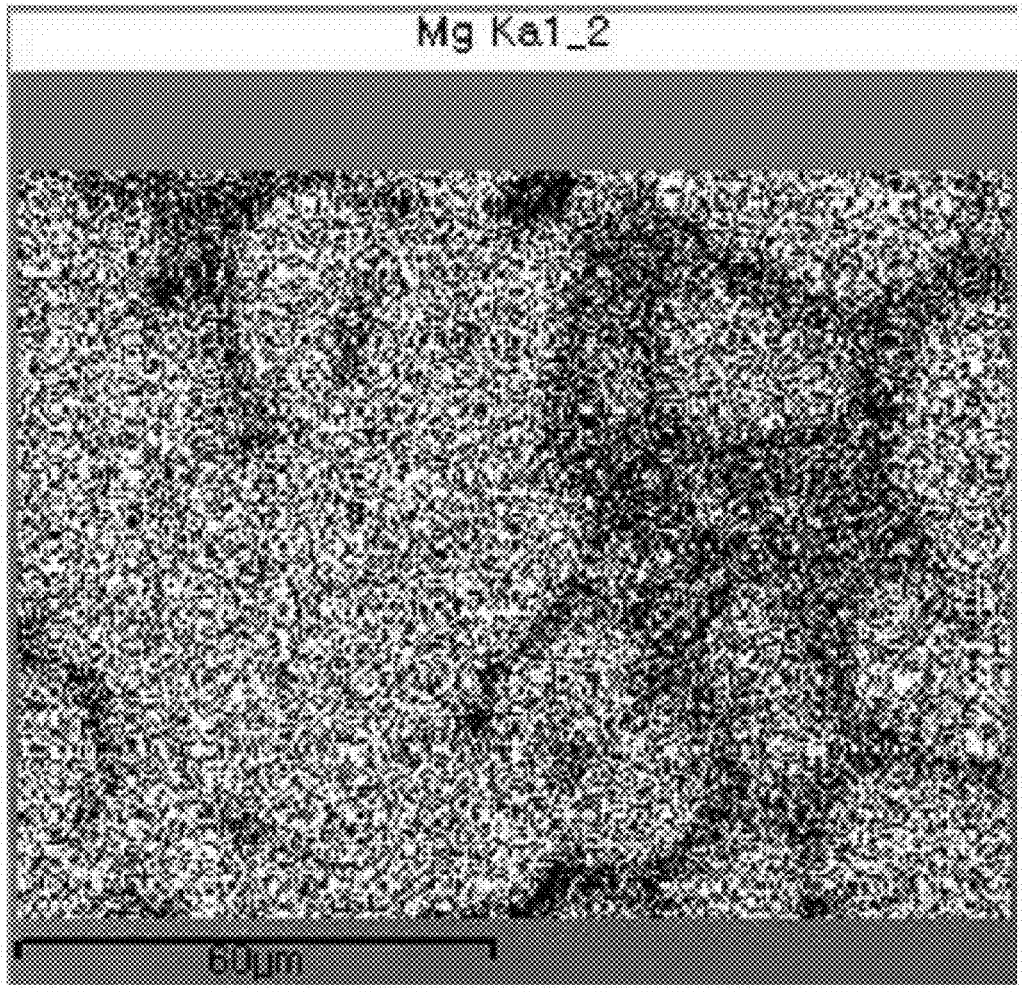
Figure 5C:
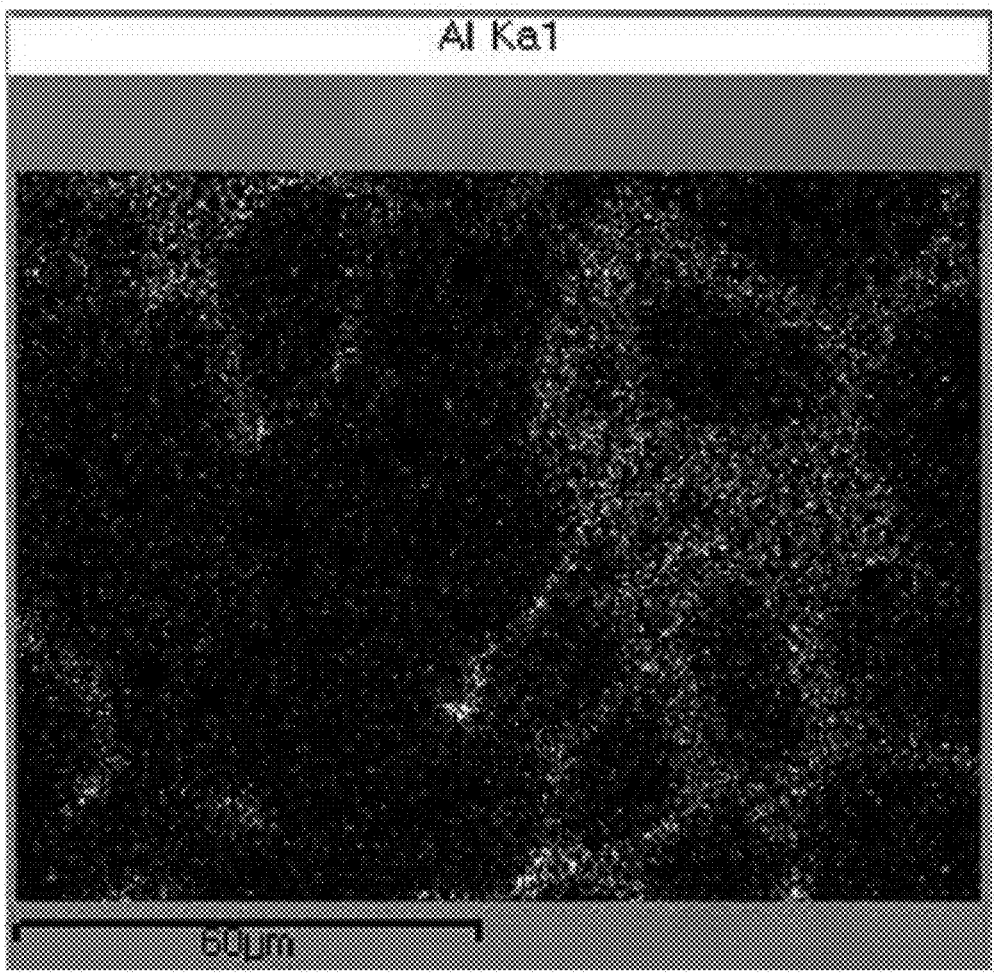
Figure 5D:
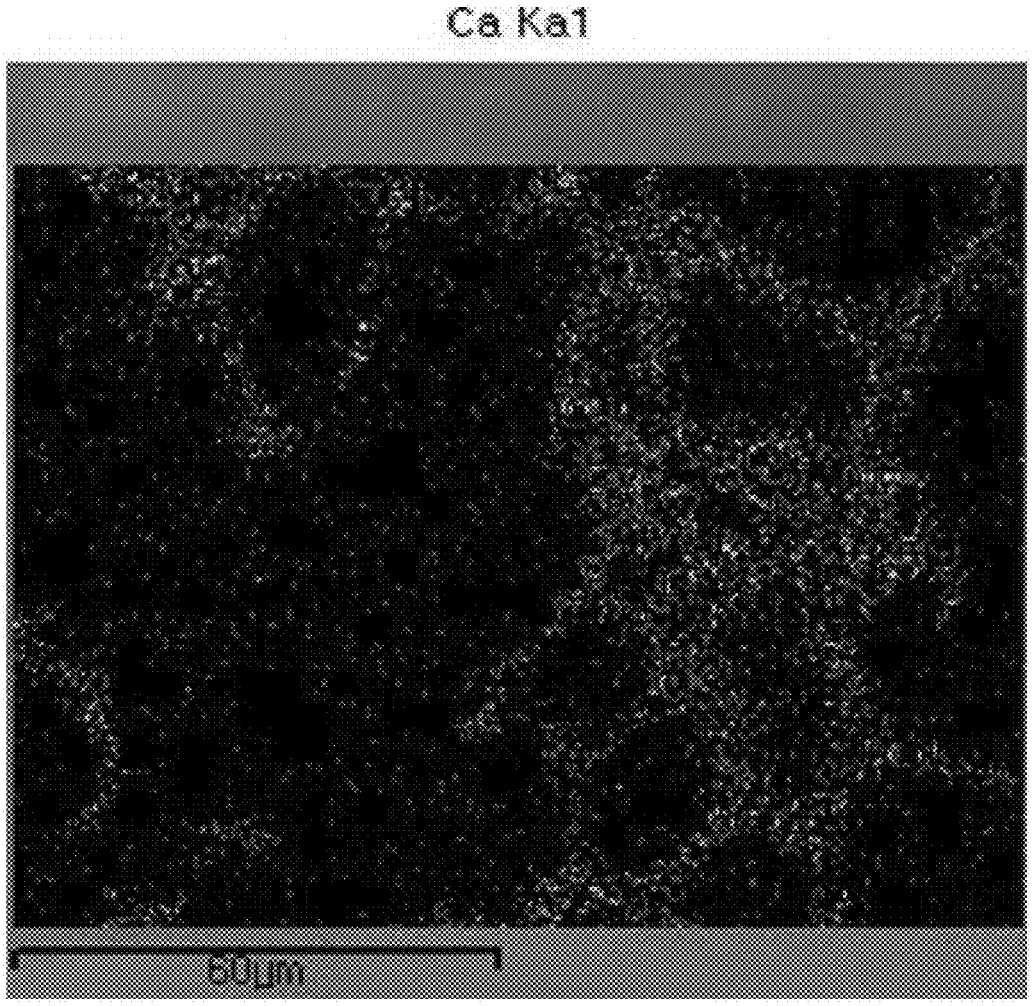

FIG. 4*a* is an image showing the microstructure of a die-cast product using AZ91D according to a comparative example. FIGS. 4*b* and 4*c* are images showing microstructures of die-cast products of Mg alloys prepared by adding 0.3% and 0.7% by weight of CaO into AZ91D magnesium alloy, respectively, according to the present invention. The meaning of 'CaO addition' in the present invention implies that the reduction reaction process is undergone after the addition of the CaO. The images of microstructures are taken after performing cold chamber die casting. The magnesium alloy according to the present invention was finer and denser in microstructure than the magnesium alloy according to the comparative example. It can be understood that such a tendency significantly increases as the amount of CaO added into the Mg alloy increases. It is determined that this is due to $Al_2Ca$ or other phase formations ($Mg_2Ca$, and (Mg, Al, other alloying elements)$_2$Ca) which is(are) formed and distributed uniformly as the CaO is added.

FIGS. 5*a* to 5*d* are images showing EDS compositional analysis of a magnesium alloy prepared by adding 0.45% by weight of CaO into a molten AM60B alloy. As shown in FIGS. 5*a* to 5*d*, it can be observed that $Al_2Ca$ is formed and the formation of $\beta$-$Mg_N Al_{12}$ phase is suppressed.

It can be understood that existing areas of Al and Ca are similarly distributed. This means that Ca dissociated from CaO added into the molten magnesium forms a compound with Al. For this reason, the formation of $\beta$-$Mg_{17}Al_{12}$ phase, which is highly brittle and observed in typical Mg—Al based alloys, is suppressed so that the ductility of the magnesium alloy is increased and the strength is also increased due to formation of $Al_2Ca$.

Figure 6A:
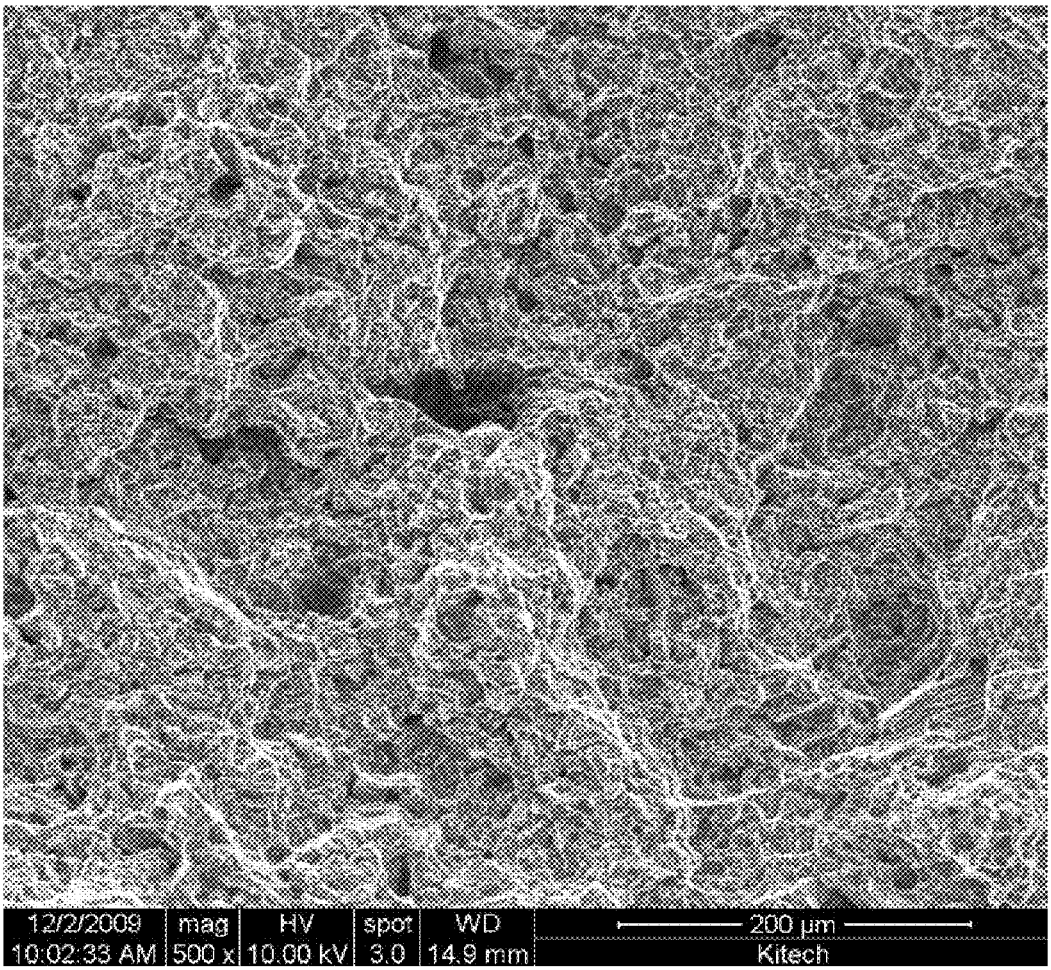
FIGS. 6*a* to 6*d* are SEM images showing fractured surfaces of tensile specimens of magnesium alloys manufactured according to the present invention.
Figure 6B:
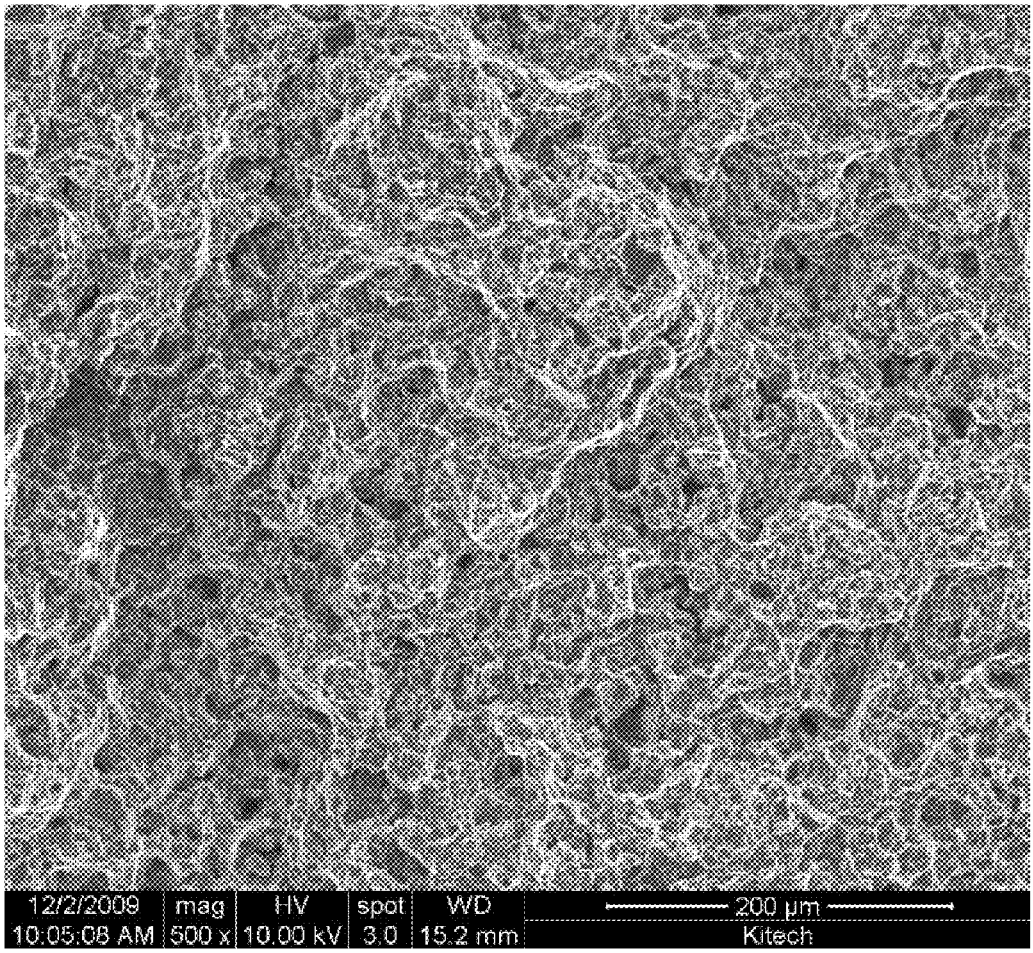
Figure 6C:
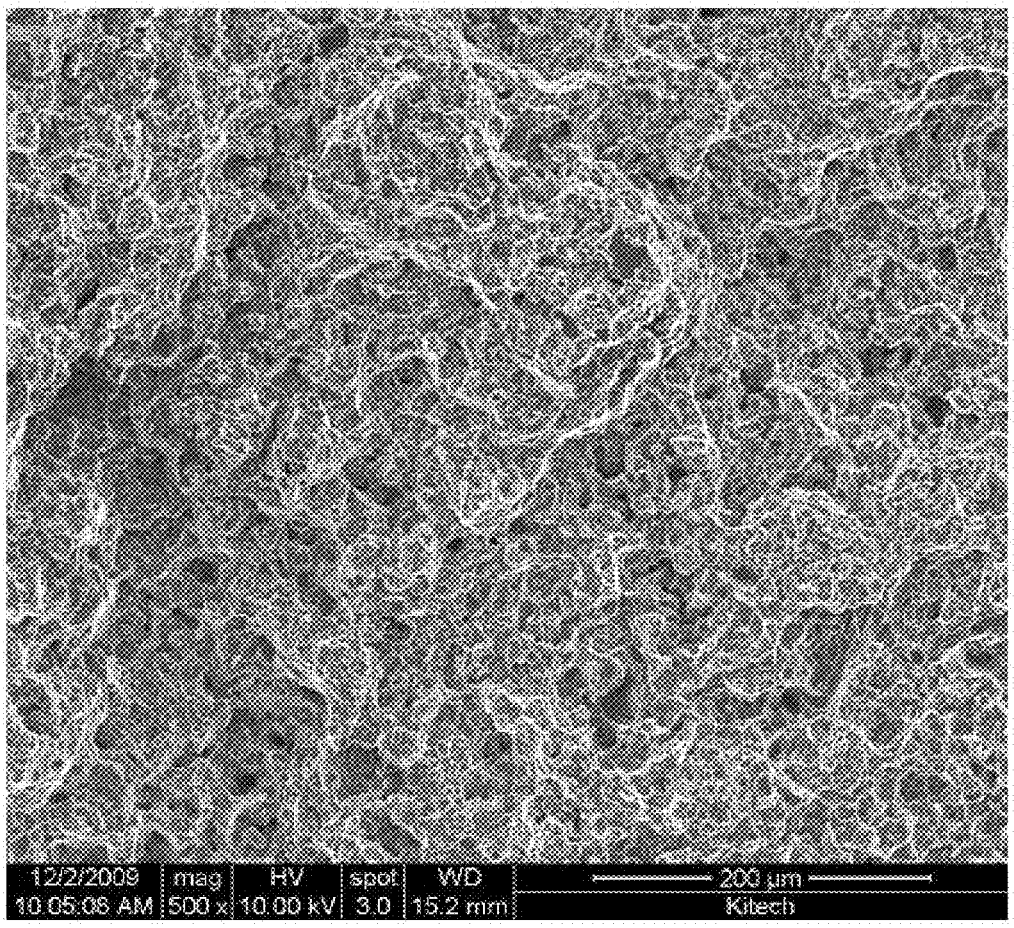
Figure 6D:
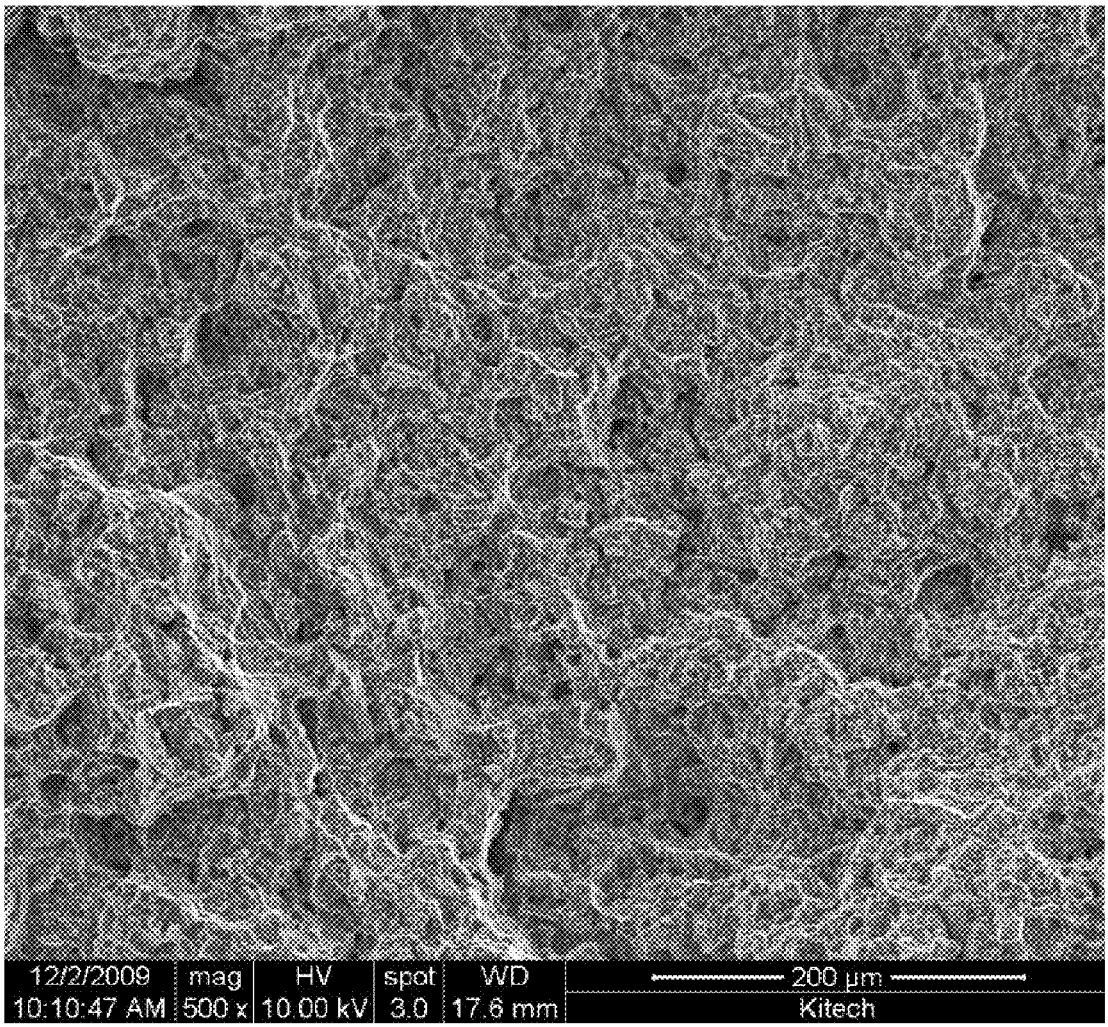

FIG. 6*a* is a SEM image showing a fractured surface of a tensile specimen of a commercially available AM60B alloy, and FIGS. 6*b* to 6*d* are SEM images showing fractured surfaces of tensile specimens of magnesium alloys prepared by making CaO react with AM60B according to the present invention.

It can be observed that there are many dimples (recessed portions) due to casting defects such as pores in the alloy.

Compared to this, it can be observed that the number of dimples of tensile specimens is significantly decreased in the magnesium alloys prepared by adding CaO (alloy of FIG. 6*b* prepared by adding 0.25 wt % of CaO into AM60B, alloy of FIG. 6*c* prepared by adding 0.58 wt % of CaO into AM60B, and alloy of FIG. 6*d* prepared by adding 0.98 wt % of CaO into AM60B). That is, the addition of CaO leads to a decrease in casting defects, for example, decrease in pores of the alloy and decrease in oxides and inclusions.

Figure 7:
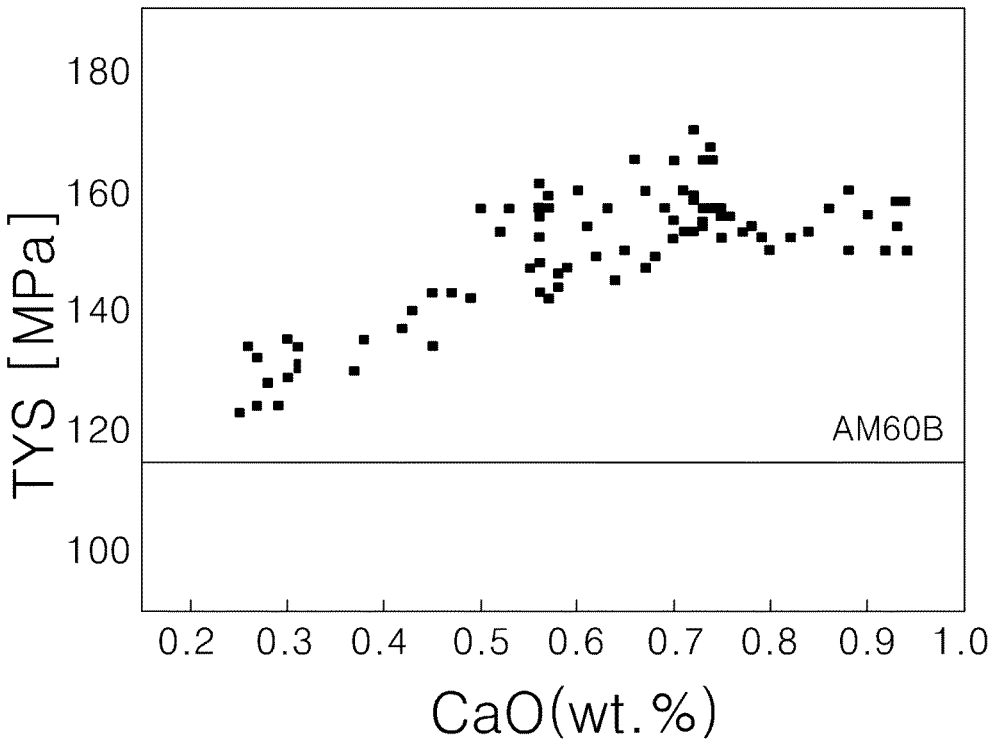
FIG. 7 is a graph showing room-temperature yield strengths of magnesium alloys manufactured with varying CaO content according to the present invention, compared to a room-temperature yield strength of a magnesium alloy without using CaO.

FIG. 7 is a graph showing room-temperature yield strength (TYS) when CaO is added into a magnesium alloy. Herein, a line indicates the room-temperature yield strength of the AM60B alloy in which CaO is not added.

In an exemplary embodiment, the experiments were performed by adding 0.2 wt % to 1.0 wt % of CaO into an AM60B magnesium alloy.

As shown in FIG. 7, when 0.3 wt % of CaO is added into a magnesium alloy, the room-temperature yield strength is in the range of about 130 [MPa] to 137 [MPa]; when 0.7 wt % of CaO is added into a magnesium alloy, the room-temperature yield strength is in the range of about 151 [MPa] to 168 [MPa]; and when 0.9 wt % of CaO is added into a magnesium alloy, the room-temperature yield strength is in the range of about 156 [MPa]. As the added amount of CaO was increased within the range of 0.3 wt % to 0.7 wt %, the room-temperature yield strength was also increased.

The yield strength according to the added amount (wt %) of CaO is presented in Table 2 below.

TABLE 2

| Alloy | Added amount of CaO | Yield strength [MPa] |
|---|---|---|
| Magnesium alloy (AM60B) | 0.2~0.3 wt % | 123~137 |
| | 0.3~0.4 wt % | 131~138 |
| | 0.4~0.5 wt % | 137~142 |
| | 0.5~0.6 wt % | 141~161 |
| | 0.6~0.7 wt % | 143~166 |
| | 0.7~0.8 wt % | 149~170 |
| | 0.8~0.9 wt % | 148~160 |
| | 0.9~1.0 wt % | 148~158 |

As shown in Table 2 above, the room-temperature yield strength (TYS) is most excellent at around 0.7 wt % of CaO added into the magnesium alloy.

Figure 8:
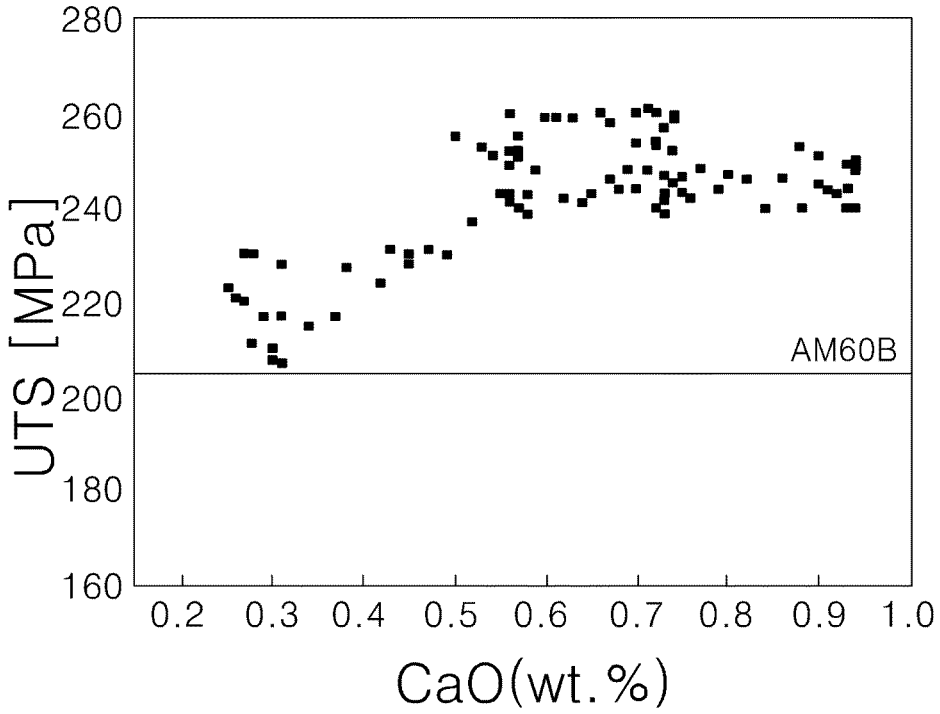
FIG. 8 is a graph showing room-temperature tensile strengths of magnesium alloys manufactured with varying CaO content according to the present invention, compared to a room-temperature tensile strength of a magnesium alloy without using CaO.

FIG. 8 is a graph showing room-temperature tensile strength (UTS) when CaO is added into a magnesium alloy. Herein, a line indicates the room-temperature tensile strength of the AM60B alloy in which CaO is not added.

In an exemplary embodiment, the experiments were performed by adding 0.2 wt % to 1.0 wt % of CaO into an AM60B magnesium alloy.

As shown in FIG. 8, when 0.3 wt % of CaO is added into a magnesium alloy, the room-temperature tensile strength is in the range of about 205 [MPa] to 230 [MPa]; when 0.7 wt % of CaO is added into a magnesium alloy, the room-temperature tensile strength is in the range of about 240 [MPa] to 261 [MPa]; and when 0.9 wt % of CaO is added into a magnesium alloy, the room-temperature tensile strength is in the range of about 245 [MPa] to 251 [MPa]. As the added amount of CaO was increased within the range of 0.3 wt % to 0.7 wt %, the room-temperature tensile strength was also increased.

The tensile strength according to the added amount (wt %) of CaO is presented in Table 3 below.

TABLE 3

| Alloy | Added amount of CaO | Tensile strength [MPa] |
|---|---|---|
| Magnesium alloy (AM60B) | 0.2~0.3 wt % | 205~231 |
| | 0.3~0.4 wt % | 205~229 |
| | 0.4~0.5 wt % | 223~232 |
| | 0.5~0.6 wt % | 239~260 |
| | 0.6~0.7 wt % | 240~260 |
| | 0.7~0.8 wt % | 240~261 |
| | 0.8~0.9 wt % | 240~255 |
| | 0.9~1.0 wt % | 240~252 |

As shown in Table 3 above, the room-temperature tensile strength is most excellent when the added amount of CaO is in the range of 0.5 wt % to 0.8 wt %.

Figure 9:
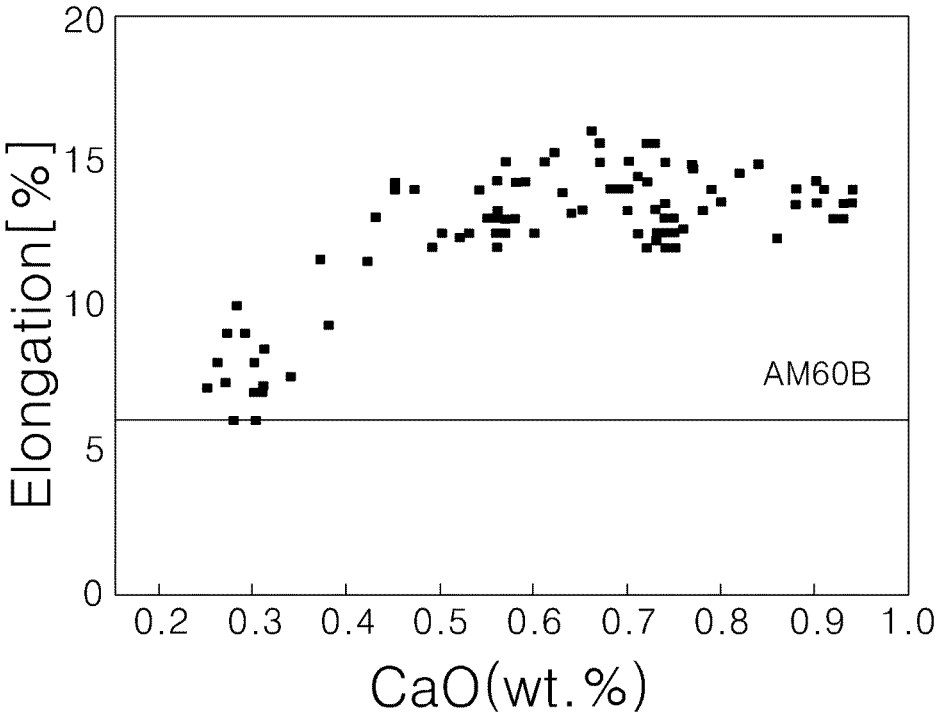
FIG. 9 is a graph showing room-temperature elongations of magnesium alloys manufactured with varying CaO content according to the present invention, compared to a room-temperature elongation of a magnesium alloy without using CaO.

FIG. 9 is a graph showing the room-temperature elongation of a magnesium alloy into which CaO is added. Herein, a line indicates the room-temperature elongation of the AM60B alloy in which CaO is not added.

In an exemplary embodiment, the experiments were performed by adding 0.2 wt % to 1.0 wt % of CaO into an AM60B magnesium alloy.

As shown in FIG. 9, when 0.3 wt % of CaO is added into a magnesium alloy, the room-temperature elongation is in the range of about 6[%] to 10[%]; when 0.7 wt % of CaO is added into a magnesium alloy, the room-temperature elongation is in the range of about 13[%] to 15[%]; and when 0.9 wt % of CaO is added into a magnesium alloy, the room-temperature elongation is in the range of about 13[%] to 14[%].As the added amount of CaO was increased within the range of 0.3 wt % to 0.7 wt %, the room-temperature elongation was also increased.

The room-temperature elongation according to the added amount (wt %) of CaO is presented in Table 4 below.

TABLE 4

| Alloy | Added amount of CaO | Elongation [%] |
|---|---|---|
| Magnesium alloy (AM60B) | 0.2~0.3 wt % | 6~10 |
| | 0.3~0.4 wt % | 7~12 |
| | 0.4~0.5 wt % | 12~14 |
| | 0.5~0.6 wt % | 12~15 |
| | 0.6~0.7 wt % | 13~17 |
| | 0.7~0.8 wt % | 12~16 |
| | 0.8~0.9 wt % | 12~15 |
| | 0.9~1.0 wt % | 13~14 |

As shown in Table 4 above, the room-temperature elongation is most excellent when the added amount of CaO is in the range of 0.5 wt % to 0.8 wt %.

Table 5 below represents averages of mechanical properties of magnesium alloys prepared according to the present invention. Each data was obtained by averaging about 200 data measured in experiments.

TABLE 5

| | YS (MPa) | UTS (MPa) | EL (%) |
|---|---|---|---|
| AM60B | 115 | 205 | 6 |
| AM60B-0.3 wt % CaO | 130 | 220 | 9 |
| AM60B-0.5 wt % CaO | 160 | 255 | 14 |
| AM60B-0.7 wt % CaO | 165 | 260 | 14 |
| AM60B-0.9 wt % CaO | 155 | 250 | 13 |

As shown in FIGS. 7, 8 and 9, magnesium alloys manufactured using the reduction reaction of CaO added into the molten magnesium were superior in room-temperature yield strength, room-temperature tensile strength and room-temperature elongation than Mg alloys into which CaO is not added. The room-temperature mechanical properties were more improved as the added amount of CaO was larger. Such a tendency was more prominent when the added amount of CaO was in the range of 0.3 wt % to 0.7 wt %. Why the room-temperature mechanical properties are improved is because compounds such as $Mg_2Ca$, $Al_2Ca$ and $(Mg, Al)_2Ca$ are formed due to addition of CaO.

Figure 10:
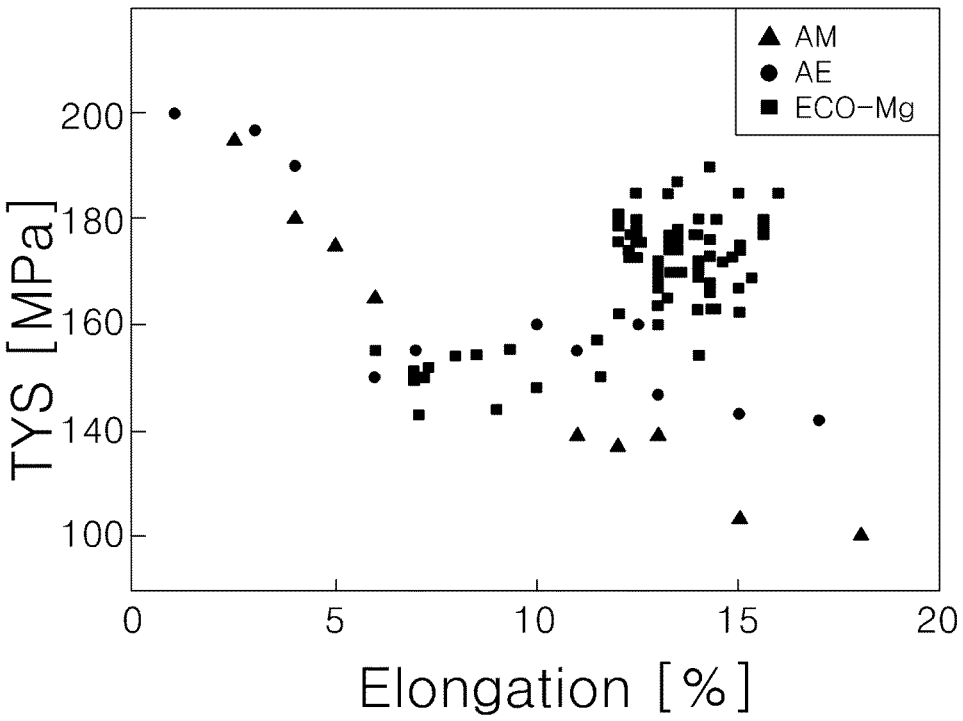
FIG. 10 is a graph showing room-temperature elongations and room-temperature tensile strengths of magnesium alloys manufactured with varying CaO content according to the present invention, compared to a room-temperature elongation and room-temperature tensile strength of a magnesium alloy without using CaO.

FIG. 10 is a graph comparing room-temperature yield strengths and room-temperature elongations between magnesium-based alloys prepared according to the present invention and typical magnesium alloys.

As shown in FIG. 10, in typical AM magnesium alloys into which Al and Mn are added and AE magnesium alloys into which Al and rare earth are added, the room-temperature yield strength and room-temperature elongation are inversely proportional to each other.

On the contrary, in CaO-added magnesium alloys according to the present invention, the room-temperature elongation increases as the room-temperature yield strength increases. In general, the yield strength of an alloy decreases if the elongation increases, which is seen from distributions of circular points (Mg—Al—RE alloy) and triangular points (Mg—Al—Mn alloy) in FIG. 10. That is, there is a trade-off relation between elongation and yield strength in general. However, as seen from the distribution of rectangular points (CaO-added magnesium alloy) in FIG. 10, CaO-added magnesium alloys show a tendency that the room-temperature yield strength also increases as the room-temperature increases.

Figure 11:
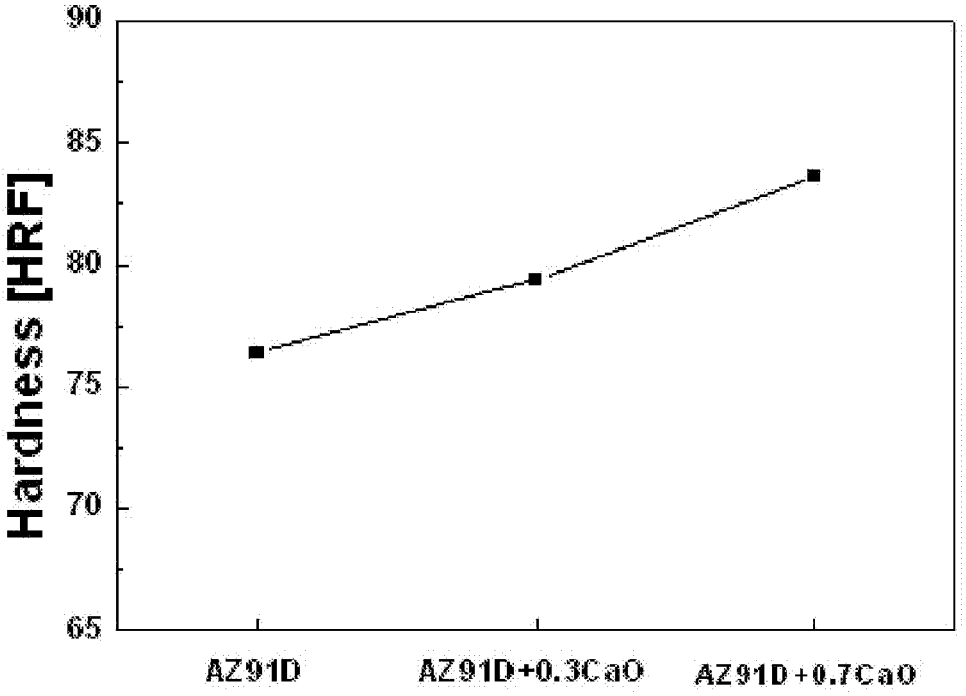
FIG. 11 is a graph showing room-temperature hardness of Mg alloys prepared by adding 0.3% and 0.7% by weight of CaO into AZ91D, respectively, compared to a room-temperature hardness of an AZ91D Mg alloy without using CaO.

FIG. 11 is a graph showing room-temperature hardness of Mg alloys prepared by adding 0.3% and 0.7% by weight of CaO into AZ91D, respectively, compared to hardness of an AZ91D Mg alloy into which CaO is not added. Rockwell hardness was measured after performing cold chamber die casting using the respective alloys. It can be confirmed that a CaO-added Mg alloy is higher in hardness than alloys into which CaO is not added. Also, it can be confirmed that room-temperature hardness increases as the added amount of CaO increases. The meaning of 'CaO addition' in the present invention implies that the reduction reaction process is undergone after the addition of the CaO.

Figure 12:
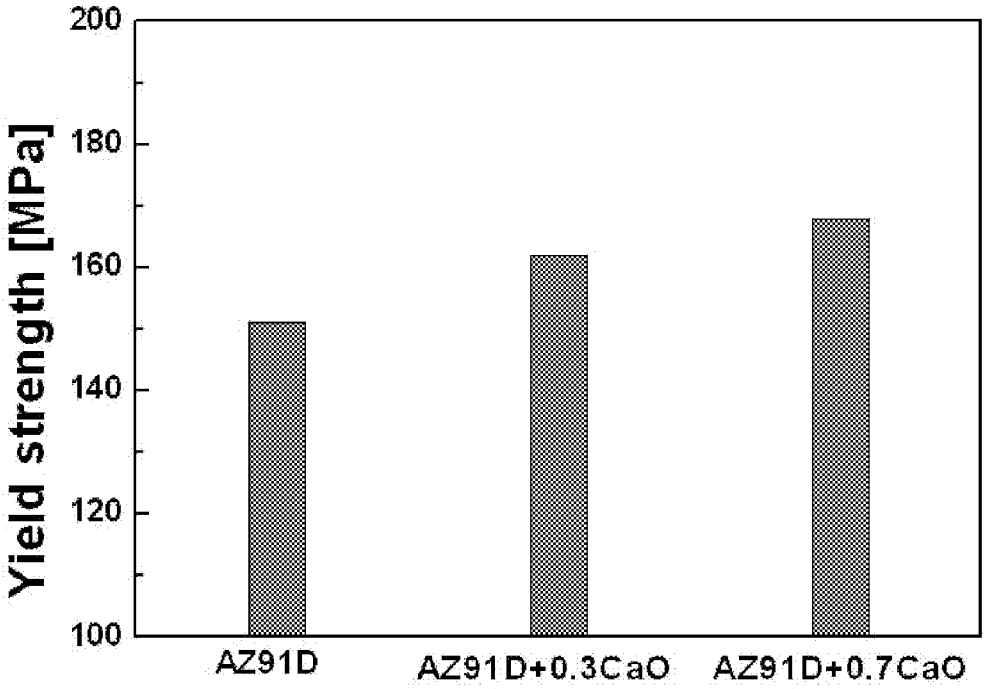
FIG. 12 is a graph showing room-temperature yield strengths of Mg alloys prepared by adding 0.3% and 0.7% by weight of CaO into AZ91D, respectively, compared to a room-temperature yield strength of an AZ91D Mg alloy without using CaO.

FIG. 12 is a graph showing room-temperature yield strengths of Mg alloys prepared by adding 0.3% and 0.7% by weight of CaO into AZ91D, respectively, compared to a room-temperature yield strength of an AZ91D Mg alloy into which CaO is not added. Room-temperature yield strengths were measured after preparing specimens through hot chamber die casting. It can be confirmed that a CaO-added Mg alloys is higher in room-temperature yield strength than alloys into which CaO is not added. It can also be understood that the room-temperature yield strength of the magnesium alloy with 0.7 wt % of CaO added is increased by about 15%, when compared to magnesium alloys into which CaO is not added. Also, it can be confirmed that room-temperature yield strength increases as the added amount of CaO increases.

Figure 13:
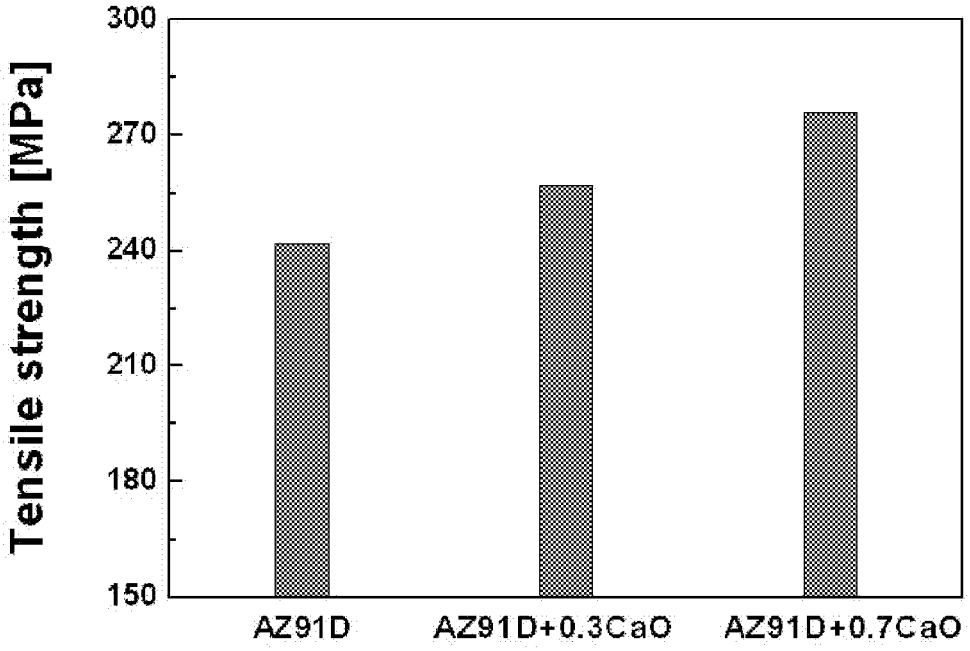
FIG. 13 is a graph showing room-temperature tensile strengths of Mg alloys prepared by adding 0.3% and 0.7% by weight of CaO into AZ91D, respectively, compared to a room-temperature tensile strength of an AZ91D Mg alloy without using CaO.

FIG. 13 is a graph showing room-temperature tensile strengths of Mg alloys prepared by adding 0.3% and 0.7% by weight of CaO into AZ91D, respectively, compared to a room-temperature tensile strength of an AZ91D Mg alloy into which CaO is not added. Room-temperature tensile strengths were measured after preparing specimens through hot chamber die casting.

It can be confirmed that a CaO-added Mg alloys is higher in room-temperature tensile strength than alloys into which CaO is not added. It can also be understood that the room-temperature tensile strength of the magnesium alloy with 0.7 wt % of CaO added is increased by about 14%, when compared to magnesium alloys into which CaO is not added. Moreover, it can be confirmed that room-temperature tensile strength increases as the added amount of CaO increases.

Figure 14:
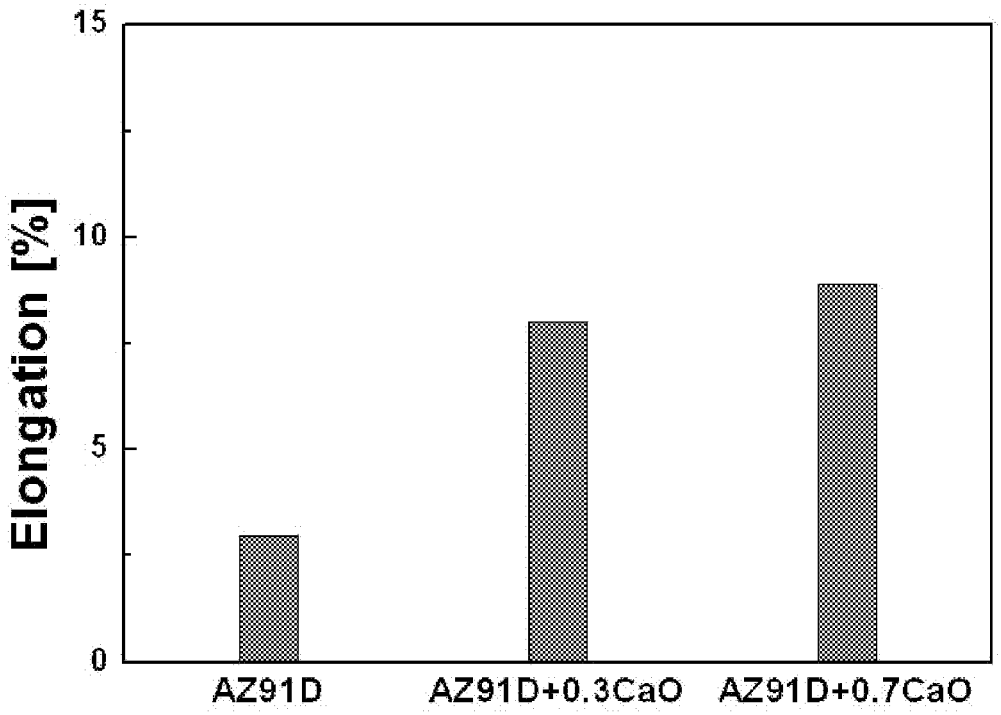
FIG. 14 is a graph showing room-temperature elongations of Mg alloys prepared by adding 0.3% and 0.7% by weight of CaO into AZ91D, respectively, compared to a room-temperature elongation of an AZ91D Mg alloy without using CaO.

FIG. 14 is a graph showing room-temperature elongations of Mg alloys prepared by adding 0.3% and 0.7% by weight of CaO into AZ91D, respectively, compared to a room-temperature elongation of an AZ91D Mg alloy into which CaO is not added. It can be confirmed that a CaO-added Mg alloys is higher in room-temperature elongation than alloys into which CaO is not added. It can also be understood that the room-temperature elongation of the magnesium alloy with 0.7 wt % of CaO added is increased to about 3 times that of a magnesium alloy into which CaO is not added. Moreover, it can be confirmed that room-temperature elongation increases as the added amount of CaO increases.

Figure 15:
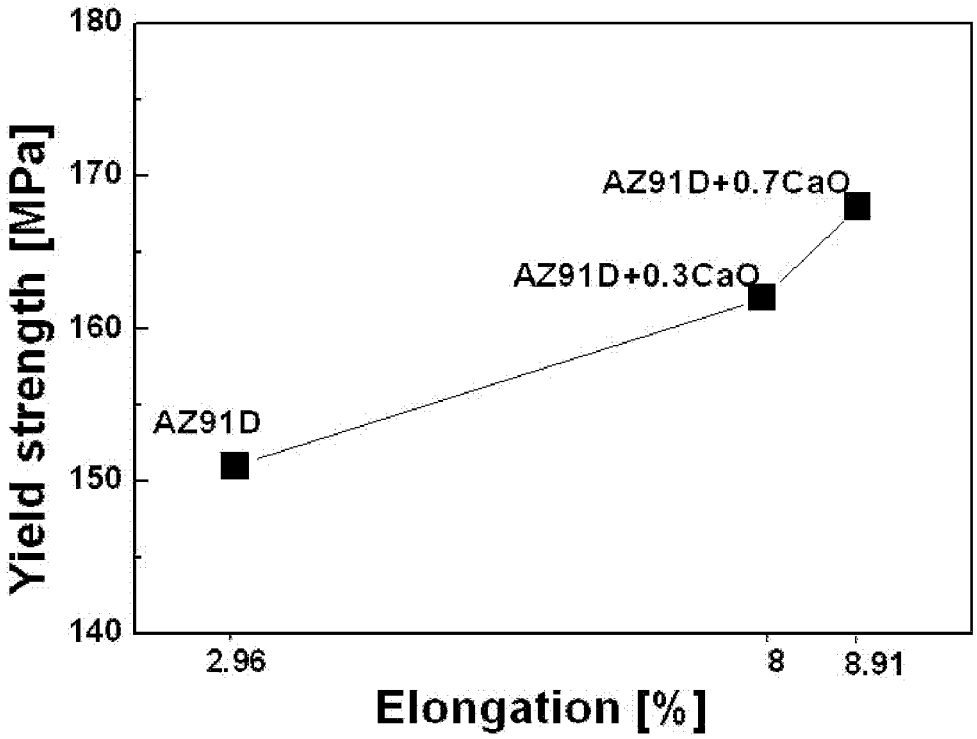
FIG. 15 is a graph showing relations between room-temperature elongation and room-temperature yield strength in Mg alloys prepared by adding 0.3% and 0.7% by weight of CaO into AZ91D, respectively, compared to a relation between room-temperature elongation and room-temperature yield strength in an AZ91D Mg alloy without using CaO.

FIG. 15 is a graph showing relations between room-temperature elongation and room-temperature yield strength in Mg alloys prepared by adding 0.3% and 0.7% by weight of CaO into AZ91D, respectively, compared to a relation between room-temperature elongation and room-temperature yield strength in an AZ91D Mg alloy without using CaO. It can be confirmed that a CaO-added Mg alloys is higher in room-temperature elongation than alloys into which CaO is not added. Also, it can be observed that both of room-temperature yield strength and room-temperature elongation increase as the added amount of CaO increases.

As described above, according to the present invention, when CaO is added into a commercially available Mg alloy, the microstructure of the magnesium alloy becomes finer, and $Mg_2Ca$, $Al_2Ca$ or (Mg, Al, other alloying elements)$_2$Ca phases are formed. Furthermore, the addition of CaO prevents the formation of $\beta$-$Mg_{17}Al_{12}$ phase which is highly brittle, and significantly reduces casting defects. Consequently, the addition of CaO enables Ca to be alloyed indirectly through a reduction reaction, thereby resulting in an increase in both of room-temperature strength and room-temperature elongation of a magnesium alloy at the same time.

While the present invention has been particularly shown and described with reference to preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A magnesium-based alloy for a die-casting product, characterized by that the magnesium-based alloy is manufactured by adding 0.05% to 1.2% by weight of CaO into a molten magnesium or magnesium alloy, wherein the magnesium-based alloy contains a compound formed through a reaction of Ca with the Mg, or other alloy elements of the magnesium alloy to have greater values of room-temperature mechanical properties than those of magnesium or magnesium alloy into which the CaO is not added, wherein the magnesium-based alloy includes Al whose composition is between about 5% and about 10% by weight of the magnesium-based alloy, wherein the magnesium-based alloy has a finer and denser microstructure than a microstructure of the magnesium or magnesium alloy before adding the CaO to the magnesium or magnesium alloy, wherein the room-temperature mechanical properties comprise a room temperature yield strength, a room-temperature tensile strength, and a room-temperature elongation, and wherein values of the room-temperature yield strength, the room-temperature tensile strength, and the room-temperature elongation all continue to increase as the added amount of CaO increases.

2. The magnesium-based alloy of claim 1, wherein the added amount of the CaO is greater than 0.3 wt % and no more than 0.9 wt %.

3. The magnesium-based alloy of claim 2, wherein the added amount of the CaO is greater than 0.3 wt % and no more than 0.7 wt %.

4. The magnesium-based alloy of claim 1, wherein the compound formed through the reaction of the Ca with the Mg or other alloy elements comprises at least one of $Mg_2Ca$, $Al_2Ca$ and $(Mg, Al)_2Ca$.

5. The magnesium-based alloy of claim 1, wherein the magnesium-based alloy includes Al whose composition is between about 5.45% and about 9.7% by weight of the magnesium-based alloy.

6. The magnesium-based alloy of claim 1, wherein the microstructure of the magnesium-based alloy continues to become finer and denser as the added amount of CaO increases.

7. A magnesium-based alloy comprising aluminum and an intermetallic compound including Ca, the aluminum being at least about 5% by weight of the magnesium-based alloy, the intermetallic compound including Ca and Mg or other alloy elements of the magnesium-based alloy, the Ca being greater than 0.21% and no more than 0.45% by weight of the magnesium-based alloy, wherein the magnesium-based alloy has a finer and denser microstructure than a microstructure of the magnesium or magnesium alloy before adding CaO to the magnesium or magnesium alloy to provide the magnesium-based alloy, wherein the magnesium-based alloy contains the intermetallic compound formed through a reaction of Ca with the Mg, or other alloy elements of the magnesium alloy to have greater values of room-temperature mechanical properties than those of magnesium or magnesium alloy into which the CaO is not added, wherein the room-temperature mechanical properties comprise a room-temperature yield strength, a room-temperature tensile strength, and a room-temperature elongation, and wherein values of the room-temperature yield strength, the room-temperature tensile strength, and the room-temperature elongation all continue to increase as an added amount of CaO increases.

8. The magnesium-based alloy of claim 7, wherein the intermetallic compound is formed by providing a melt including magnesium or magnesium alloy, or both, applying CaO on a surface of the melt, stirring an upper portion of the melt to induce a reduction reaction between the melt and the CaO proximate the surface of the melt, exhausting the CaO proximate the surface of the melt through the reduction reaction between the melt and the CaO, and reacting Ca produced by the exhaustion of the CaO with the at least one of Mg and other alloy elements of the magnesium alloy.

9. The magnesium-based alloy of claim 8, wherein formation of $\beta$-$Mg_{17}Al_{12}$ phase is suppressed to increase a value of a room-temperature elongation of the magnesium-based alloy.

10. The magnesium-based alloy of claim 7, wherein the microstructure of the magnesium-based alloy becomes finer and denser in proportion to the added amount of the CaO.

11. The magnesium-based alloy of claim 7, wherein at least 90% of the intermetallic compound is formed at grain boundaries of the magnesium-based alloy, and no more than 10% of the intermetallic compound is formed within grains of the magnesium-based alloy.

12. The magnesium-based alloy of claim 7, wherein the magnesium-based alloy includes Al whose composition is at least 5.45% by weight of the magnesium-based alloy.

13. The magnesium-based alloy of claim 12, wherein the magnesium-based alloy includes Al whose composition is no more than 9.7% by weight of the magnesium-based alloy.

14. A magnesium-based alloy consisting essentially of aluminum, Ca, and an intermetallic compound including Ca, the aluminum being at least about 5% by weight of the magnesium-based alloy, the intermetallic compound including Ca and Mg or other alloy elements of the magnesium-based alloy, the Ca being greater than 0.21% and no more than 0.45% by weight of the magnesium-based alloy, wherein the magnesium-based alloy has a finer and denser microstructure than a microstructure of the magnesium or magnesium alloy before adding CaO to the magnesium or magnesium alloy to provide the magnesium-based alloy, wherein the magnesium-based alloy contains the intermetallic compound formed through a reaction of Ca with the Mg, or other alloy elements of the magnesium alloy to have greater values of room-temperature mechanical properties than those of magnesium or magnesium alloy into which the CaO is not added, wherein the room-temperature mechanical properties comprise a room-temperature yield strength, a room-temperature tensile strength, and a room-temperature elongation, and wherein values of the room-temperature yield strength, the room-temperature tensile strength, and the room-temperature elongation all continue to increase as an added amount of CaO increases.

* * * * *